US006976464B2

(12) United States Patent
Crall

(10) Patent No.: US 6,976,464 B2
(45) Date of Patent: Dec. 20, 2005

(54) SEMI-ROTATING VALVE ASSEMBLY FOR USE WITH AN INTERNAL COMBUSTION ENGINE

(75) Inventor: Craig W. Crall, Los Gatos, CA (US)

(73) Assignee: Dragon America Motor Technologies, Inc., Mountain View, CA (US)

( * ) Notice: Subject to any disclaimer, the term of this patent is extended or adjusted under 35 U.S.C. 154(b) by 34 days.

(21) Appl. No.: 10/447,545

(22) Filed: May 28, 2003

(65) Prior Publication Data

US 2004/0237926 A1 Dec. 2, 2004

(51) Int. Cl.[7] ..... F01L 7/00
(52) U.S. Cl. ..... 123/190.1; 123/190.2; 123/80 R
(58) Field of Search ..... 120/190.1–190.2; 123/80 R, 80 BA, 81 R

(56) References Cited

U.S. PATENT DOCUMENTS

| | | | | |
|---|---|---|---|---|
| 1,083,208 A | | 12/1913 | Goodness | |
| 1,328,102 A | * | 1/1920 | Remington | 123/586 |
| 4,333,427 A | * | 6/1982 | Burillo et al. | 123/190.2 |
| 4,592,321 A | * | 6/1986 | Schulz | 123/339.17 |
| 4,635,590 A | * | 1/1987 | Gerace | 123/190.1 |
| 4,776,306 A | * | 10/1988 | Matsuura et al. | 123/190.2 |
| 4,831,985 A | * | 5/1989 | Mabee et al. | 123/399 |
| 4,858,577 A | * | 8/1989 | Matsuura et al. | 123/190.2 |
| 4,944,261 A | | 7/1990 | Coates | |
| 4,969,918 A | * | 11/1990 | Taniguchi | 123/190.2 |
| 4,989,576 A | | 2/1991 | Coates | |
| 5,205,251 A | | 4/1993 | Conklin | |
| 5,490,485 A | | 2/1996 | Kutlucinar | |
| 5,579,734 A | | 12/1996 | Muth | |
| 5,626,108 A | | 5/1997 | Kato et al. | |
| 5,706,775 A | | 1/1998 | Schweter et al. | |
| 5,724,926 A | | 3/1998 | Wilke | |
| 5,816,203 A | | 10/1998 | Muth | |
| 5,878,707 A | | 3/1999 | Ballard | |
| 5,906,180 A | | 5/1999 | Wilke | |
| 5,911,203 A | | 6/1999 | Lambert et al. | |
| 5,941,206 A | | 8/1999 | Smith et al. | |
| 5,975,433 A | | 11/1999 | Hasegawa et al. | |
| 5,996,544 A | | 12/1999 | Bartos | |

(Continued)

FOREIGN PATENT DOCUMENTS

JP 62078415 A * 4/1987 ..... F01L 7/08

(Continued)

OTHER PUBLICATIONS http://www.a-car.com/valves/rotary.html, "Rotary Valves Development", pp. 1-4.

(Continued)

*Primary Examiner*—Noah P. Kamen
(74) *Attorney, Agent, or Firm*—Clifford A. Poff

(57) ABSTRACT

The present invention is directed to a semi-rotating valve assembly that may be used in conjunction with an internal combustion engine. The semi-rotating valve of the present invention comprises a valve shaft disposed substantially within a valve housing, wherein the valve shaft is configured to rotate less than 360 degrees with respect to the valve housing to selectively open and close the valve. The reduced rotation of the valve shaft reduces friction, heat and wear. An interlocking sealing mechanism that may be used in conjunction with the semi-rotating valve of the present invention, along with means for cooling the valve, also are disclosed. Further, means for varying an aperture size associated with the valve also are provided, wherein the means for varying is configured to compensate for differences in engine speed to further improve efficiency and reduce fuel consumption and emissions.

53 Claims, 15 Drawing Sheets

U.S. PATENT DOCUMENTS

| | | | | |
|---|---|---|---|---|
| 6,027,098 | A | 2/2000 | Nevrekar | |
| 6,036,060 | A | 3/2000 | Münsch et al. | |
| 6,098,579 | A | 8/2000 | Northam et al. | |
| 6,155,215 | A | 12/2000 | Muth | |
| 6,158,465 | A | 12/2000 | Lambert et al. | |
| 6,213,141 | B1 | 4/2001 | Eggleston | |
| 6,237,556 | B1 | 5/2001 | Smith et al. | |
| 6,253,778 | B1 | 7/2001 | Smolarek et al. | |
| 6,254,082 | B1 | 7/2001 | Sugimoto et al. | |
| 6,257,191 | B1 | 7/2001 | Kutlucinar | |
| 6,267,091 | B1 | 7/2001 | Nishida | |
| 6,293,242 | B1 | 9/2001 | Kutlucinar | |
| 6,308,676 | B1 | 10/2001 | Coates | |
| 6,308,677 | B1 * | 10/2001 | Bohach et al. | 123/190.1 |
| 6,321,699 | B1 | 11/2001 | Britton | |
| 6,332,451 | B1 | 12/2001 | Sato et al. | |
| 6,332,600 | B2 | 12/2001 | Eggleston | |
| 6,345,805 | B1 | 2/2002 | Chatufale | |
| 6,378,481 | B1 | 4/2002 | Conradty et al. | |
| 6,415,756 | B1 | 7/2002 | Lee | |

FOREIGN PATENT DOCUMENTS

| | | | | |
|---|---|---|---|---|
| JP | 2001342900 | A * | 12/2001 | F02M 9/08 |

OTHER PUBLICATIONS http://www.coatesengine.com/CSRV_cylinderhaad.html, "Coates Special_Rotary Valve Cylinder Head", pp. 1-4.
http://www.coatesengine.com/lookmom_noCamshaft.htm, Ray T. Bohacz, "Look Mom, No Camshaft!", *Popular Hot Rodding*, pp. 1-4.
http://www.coatesengine.com/Products_c86GE_natural_gas_engine.html, "Coated C86GE Natural Gas Engine".
http://www.coatesengine.com/t10_eDynamic.htm, Engine Dynamics.
http://www.coatesengine.com/t11_eDynamic.htm, Engine Dynamics.
http://www.coatesengine.com/t4_advantages.htm, Advantages of the Engine.
http://www.coatesengine.com/t5_advantages.htm, Advantages of the Engine (continue).
http://www.coatesengine.com/t6_advantages.htm, Advantages of the Engine (continue).
http://www.coatesengine.com/t7_advantages.htm, Advantages of the Engine (continue).
http://www.coatesengine.com/t8_advantages.htm, Advantages of the Engine (continue).
http://www.coatesengine.com/t9_cAnalysis.htm, Comparative Analysis.
http://www.coatesengine.com/technology.html, CSRV Engine Description.
http://www.coatesengine.com/technology2.html, CSRV Engine Description.
http://www.coatesengine.com/technology3.html, CSRV Engine Description (continue).
http://www.coatesengine.com/TheEngineOfTheFuture.html, George J. Coates, "The Engine of The Future", *Automotive Technology Asia*, pp. 1-2.
http://www.lortim.demon.co.uk/aspin/, "Aspin Rotart Engine", Aspin Rotary Engine Library, pp. 1-10.
http://www.lortim.demon.co.uk/aspin/lib193/a.htm, Wharfdale, "How The Aspin Engine Works", *The Motor Cycle*, pp. 1-2.

* cited by examiner

SEMI-ROTATING VALVE ASSEMBLY FOR USE WITH AN INTERNAL COMBUSTION ENGINE

FIELD OF THE INVENTION

The present invention relates to a valve assembly suitable for use with an internal combustion engine, and more specifically, a semi-rotating valve assembly configured to reduce the consumption of fuel and the emission of pollutants.

BACKGROUND OF THE INVENTION

Most modern internal combustion engines utilize a four stroke operating sequence known as the Otto cycle. The Otto cycle comprises an intake stroke, in which an intake valve opens and a mixture of air and fuel is directed into the cylinder of the engine. A compression stroke then occurs in which the piston compresses the mixture of fuel and air to increase the pressure in the cylinder. A spark provided by a spark plug ignites the mixture just before the piston reaches the top of the cylinder, causing the piston to be forced down the cylinder in the power stroke. An exhaust valve then opens in the exhaust stroke, in which burned gases are forced out of the cylinder. The four strokes are repeated continuously during operation of the engine.

Internal combustion engines operating on the Otto cycle generally utilize spring-loaded poppet valves that selectively open and close the intake and exhaust ports during each cycle. In most engines, a crankshaft is coupled to a timing belt or chain, which in turn is coupled to a camshaft that rotates to open the intake and exhaust valves during the intake and exhaust strokes, respectively. A spring associated with each valve closes the valve during the other cycles.

There are several drawbacks associated with the use of such spring-loaded poppet valves. One drawback is that the valves protrude into the cylinder during each cycle, and there is an inherent risk that the piston may contact an open valve at a high force and cause substantial engine damage. Additionally, valve timing events may be limited due to the protrusion of the valve head into the cylinder.

Another disadvantage with the use of poppet valves in conventional internal combustion engines is that a relatively stiff spring is used to close the valves. Therefore, a relatively strong force is required to overcome the resistive force of the spring to open each valve during each cycle, reducing the efficiency of the engine. Moreover, due to the stiff resistive force provided by the springs, valve timing events may be limited. For example, there generally is a short time period during which both the intake valve and the exhaust valve are open when conventional poppet valves and stiff springs are employed. During this overlap period, unburned hydrocarbon molecules may remain in the combustion chamber for a subsequent cycle, thereby adversely affecting dynamic compression and reducing engine efficiency.

Yet a further disadvantage associated with the use of conventional poppet valves is that energy is lost as a result of an obstruction of the orifice, i.e., because a portion of a poppet valve protrudes through the orifice and into the cylinder. Moreover, flow into the cylinder through the intake port is disrupted when it contacts the head of the poppet valve, i.e., the portion of the valve that seals the orifice in the closed state. The intake valve head may cause turbulence and dead air space within the cylinder, which in turn reduces the efficiency of the engine. Furthermore, when the head of the exhaust valve protrudes into the cylinder during the exhaust stroke, burned gases may not efficiently flow out of the cylinder, which further reduces combustion capabilities.

Various rotational valve designs, which may be used in conjunction with internal combustion engines, have been developed that seek to overcome several of the drawbacks associated with conventional poppet valves. One primary advantage of a rotational valve assembly is the capability to have a substantially unobstructed flow path through a port of a rotating valve. Specifically, because a conventional poppet valve is not employed, and therefore does not obstruct the flow path through an intake or exhaust port, a rotational valve has the potential to significantly increase airflow capability into a cylinder. Moreover, since the stiff spring used in conjunction with conventional poppet valves may be omitted, rotational valve assemblies may achieve reduced mechanical loads.

Previous rotary valve assemblies have included rotating discs, cylinders, sleeves and other spheroidal rotating mechanisms. Such previously known rotational valves rotate a full 360 degrees and are timed such that their apertures overlap with the cylinder during the intake and exhaust strokes. However, due to their 360 degree rotation and continuous motion, such fully rotational valves may experience high temperatures and extreme friction, resulting in high rates of wear imposed on the valve and any related sealing mechanisms.

Moreover, such fully rotational valves generally have fixed aperture sizes, i.e., the size of the aperture in registration with the cylinder may not be varied as the valve rotates. Accordingly, fuel consumption and emissions may be increased by providing a relatively large aperture, particularly during idling conditions.

U.S. Pat. No. 4,944,261 to Coates describes a rotary valve assembly for use in an internal combustion engine. The assembly comprises a two-piece cylinder head that accommodates rotary intake valves and rotary exhaust valves mounted on independent shafts. Each intake valve has two passageways for the introduction and interruption of fuel/air mixture into the cylinder, and each exhaust valve has two passageways for the evacuation and interruption of spent gases from the cylinder.

As the intake valve shaft rotates a full 360 degrees, as driven by a crankshaft, the passageways of the intake valves are selectively placed in registration with the cylinder during intake strokes only. Similarly, the passageways of the exhaust valves are placed in registration with the cylinder during exhaust strokes only. At all other times of rotation, fluid communication is inhibited. By using two passageways on each valve, and by employing independent shafts, the Coates patent states that the valves rotate at a one-quarter speed in relationship to the crankshaft, thereby reducing overall wear on the valves and enabling cooler operating temperatures.

One drawback associated with the rotary valve system described in the Coates patent is that each intake and exhaust valve is fully rotational, i.e., each valve rotates continuously 360 degrees. Accordingly, even though the valves rotate at a one-quarter speed in relationship to the crankshaft, the continuous motion of the valves is still expected to result in relatively high levels of friction, heat and wear.

Moreover, because the valves described in the Coates patent are continuously rotating, the size of the aperture in registration with the cylinder may not be varied. Specifically, while the rotational speed of the valves may be varied in response to the crankshaft rotation, the actual aperture size of the valves remains fixed. It would be advantageous to provide a mechanism configured to vary the aperture size to further improve efficiency at a variety of engine speeds.

Furthermore, while the spherical rotary valve assembly described in the Coates patent may be actuated using a plurality of gears, the assembly does not appear to be easily adaptable for use with other means for actuating, for example, camshafts, solenoids, and other mechanisms. The capability to employ such other means for actuating may afford more design flexibility.

U.S. Pat. No. 6,308,677 to Bohach et al. (Bohach) describes an overhead rotary valve assembly fitted into a cylinder head of an internal combustion engine. The rotary valve comprises diametrical polygonal openings formed therein to bring intake and exhaust ports into and out of alignment with passages leading to and from the combustion chamber. Sprockets that are mechanically driven by the crankshaft are employed to cause the rotary valve assembly to rotate continuously in a 360 degree motion.

The rotary valve system described in the Bohach patent has several drawbacks, many of which are similar to drawbacks described hereinabove with respect to the Coates patent. Specifically, the rotary valve system of the Bohach patent is fully rotational, i.e., rotates continuously 360 degrees. The continuous motion of the valve is expected to result in relatively high levels of friction, heat and wear. Additionally, because the valve described in the Bohach patent is continuously rotating, the size of the aperture in registration with the cylinder may not be varied, as described hereinabove with respect to the Coates patent. Finally, while the rotary valve system described in the Bohach patent is actuated using a plurality of sprockets operatively coupled to the crankshaft, the assembly does not appear to be easily adaptable for use with other means for actuating, such as camshafts, solenoids, etc., which may afford more design flexibility.

Another rotary valve system is described in U.S. Pat. No. 6,293,242 to Kutlucinar. The Kutlucinar patent describes a rotary valve assembly having an elongated valve body mounted in a housing positioned above a head port of an engine. The rotary valve includes an intake port and an exhaust port defined by a valve body, and is arranged for periodic communication with the head port and combustion chamber as the valve rotates. The rotary valve system also includes a secondary intake port for controlling the flow of intake gases into the rotary valve.

The Kutlucinar patent also discloses a sealing system intended to seal the rotary valve in the longitudinal and radial directions. In operation, the sealing elements mounted on the rotary valve dynamically change position depending on the stage of the combustion cycle, for example, the sealing system is configured to form a tighter seal during the combustion stage than during the intake stage.

Additionally, the Kutlucinar patent discloses a throttle control for the rotary valve that has a sliding throttle plate configured to vary the effective size of the intake port opening to compensate for differences in engine speed. The sliding throttle plate may move back and forth in a longitudinal direction within the rotary valve, such that the longitudinal movement of the sliding throttle plate may cover the intake port different amounts at different engine speeds.

The rotary valve system described in the Kutlucinar patent also has several drawbacks, many of which are similar to drawbacks described hereinabove with respect to the Coates and Bohach patents. In particular, the rotary valve system of the Kutlucinar patent is fully rotational, i.e., rotates continuously 360 degrees. The continuous motion of the valve is still expected to result in relatively high levels of friction, heat and wear, despite the fact that a cooling system is employed. Additionally, because the rotary valve system described in the Kutlucinar patent is actuated using a plurality of gears operatively coupled to the crankshaft, like the above-referenced patents, the assembly does not appear to be easily adaptable for use with other means for actuating that may afford more design flexibility.

Another drawback associated with the Kutlucinar patent is the complexity of the sealing system. Specifically, the sealing system employs a significant number of seals, particularly small seals, as depicted in FIG. 6 of that patent. It would be desirable to provide an effective sealing system for a rotary valve that employs significantly fewer components.

In view of these drawbacks of previously known systems, it would be desirable to provide apparatus and methods for a semi-rotating valve assembly that is configured to be easily incorporated into existing internal combustion engine designs.

It also would be desirable to provide apparatus and methods for a semi-rotating valve assembly that improves fuel efficiency relative to known fully rotating valve assemblies.

It further would be desirable to provide apparatus and methods for a semi-rotating valve assembly that reduces the emission of pollutants.

It still further would be desirable to provide apparatus and methods for a semi-rotating valve assembly that improves horsepower and torque.

It still further would be desirable to provide apparatus and methods for a semi-rotating valve body that is configured to rotate less than 360 degrees with respect to a valve housing, thereby reducing friction, heat and wear on the valve body and related sealing components.

It yet further would be desirable to provide apparatus and methods for a semi-rotating valve assembly having an improved sealing assembly configured to effectively seal the valve in radial and longitudinal directions.

It still further would be desirable to provide apparatus and methods for a semi-rotating valve assembly having a means for cooling configured to further reduce valve temperatures and exhaust emissions.

It yet further would be desirable to provide apparatus and methods for a semi-rotating valve assembly that may be actuated using any number of means for actuating to afford more design flexibility.

It still further would be desirable to provide apparatus and methods for a semi-rotating valve assembly that may be used in conjunction with means for varying an aperture size associated with the valve, the means for varying compensating for differences in engine speed to improve engine efficiency and reduce fuel consumption and emissions.

SUMMARY OF THE INVENTION

In view of the foregoing, it is an object of the present invention to provide apparatus and methods for a semi-rotating valve assembly that is configured to be easily incorporated into existing internal combustion engine designs.

It is also an object of the present invention to provide apparatus and methods for a semi-rotating valve assembly that improves fuel efficiency relative to known fully rotating valve assemblies.

It is a further object of the present invention to provide apparatus and methods for a semi-rotating valve assembly that reduces the emission of pollutants.

It is yet another object of the present invention to provide apparatus and methods for a semi-rotating valve body that is configured to rotate less than 360 degrees with respect to a valve housing, thereby reducing friction, heat and wear on the valve and body related sealing components.

It is still another object of the present invention to provide apparatus and methods for a semi-rotating valve assembly having an improved sealing assembly configured to effectively seal the valve in radial and longitudinal directions.

It is yet another object of the present invention to provide apparatus and methods for a semi-rotating valve assembly having a means for cooling configured to further reduce valve temperatures and exhaust emissions.

It is yet another object of the present invention to provide apparatus and methods for a semi-rotating valve assembly that may be actuated using any number of means for actuating to afford more design flexibility.

It is still a further object of the present invention to provide apparatus and methods for a semi-rotating valve assembly that may be used in conjunction with means for varying an aperture size associated with the valve, the means for varying compensating for differences in engine speed to improve engine efficiency and reduce fuel consumption and emissions.

These and other objects of the present invention are accomplished by providing a valve body having a substantially cylindrical shape, and further having a first side port disposed in a first lateral surface of the valve body and a second side port disposed in a second lateral surface of the valve body. A passage extends between the first side port and the second side port to allow fluid communication therebetween.

The valve body is disposed substantially within a cylindrically-shaped bore of a valve housing. The valve body is configured to rotate less than 360 degrees with respect to the valve housing, thereby selectively enabling and prohibiting fluid communication between the passage of the valve body and a cylinder of an internal combustion engine. Specifically, partial rotation of the valve body in a first direction enables fluid communication, while partial rotation of the valve body in an opposing direction inhibits fluid communication with the cylinder.

Advantageously, because the valve body rotates less than 360 degrees with respect to the valve housing, friction, heat and wear on the valve body and related sealing components may be reduced compared to known fully rotational valves. Moreover, because a valve body provided in accordance with the present invention may dwell when not in use, e.g., an intake valve body does not substantially move during the compression, power and exhaust strokes, friction, heat and wear is further reduced.

Means for actuating a semi-rotating valve, provided in accordance with the present invention, also are provided. Any number of means for actuating may be employed to cause partial rotation of the valve body. For example, camshafts, solenoids, rocker arms, chains, gears, belts, hydraulics, pneumatics, electric actuators, and/or other means may be employed to cause partial rotation of the valve body. Advantageously, the present invention allows considerable flexibility with respect to the number of different means for actuating that may be employed, particularly compared to prior art rotational valve assemblies that rely solely on gearing mechanisms to provide rotation of the valve. Such design flexibility provides various advantages, for example, partial rotation of the valve body and the attainment of variable aperture sizes and timing events, as generally described hereinbelow.

In accordance with another aspect of the present invention, an interlocking sealing mechanism is used in conjunction with the semi-rotating valve of the present invention. The interlocking sealing mechanism comprises a plurality of interlocking components configured to seal the valve assembly in both radial and longitudinal directions. Several of the components have tapered portions configured to mate with other tapered components. Other sealing components are configured to be seated within cavities of other components, thereby providing an interlocking feature that enhances sealing capabilities. Moreover, the interlocking sealing mechanism of the present invention employs relatively few seals compared to known sealing mechanisms.

In a preferred embodiment, the semi-rotating valve assembly of the present invention further comprises at least one cooling passage disposed in a valve body substantially adjacent to the valve housing. The cooling passages preferably at least partially surround the valve housing, and are configured to carry heat away from the valve bodies by circulating coolant through the passages. Advantageously, when such cooling passages are used in conjunction with an exhaust valve, cooler exhaust temperatures and lower NOx emissions may be achieved.

In a preferred embodiment of the present invention, means for varying an aperture size associated with the semi-rotating valve of the present invention also are employed. The means for varying is configured to vary the aperture size by varying a degree of rotation of the semi-rotating valve based on operating conditions. For example, the means for varying an aperture size may increase aperture size associated with the valve during an acceleration period, and may reduce aperture size during idling conditions, thereby improving engine efficiency and reducing fuel consumption and emissions.

Apparatus and methods for using a semi-rotating valve assembly in conjunction with a conventional internal combustion engine, whereby a first semi-rotating valve of the present invention is employed as an intake valve, and a second semi-rotating valve is employed as an exhaust valve, also are provided.

BRIEF DESCRIPTION OF THE DRAWINGS

Further features of the invention, its nature and various advantages will be more apparent from the accompanying drawings and the following detailed description of the preferred embodiments, in which.

DETAILED DESCRIPTION OF THE INVENTION

Figure 1:
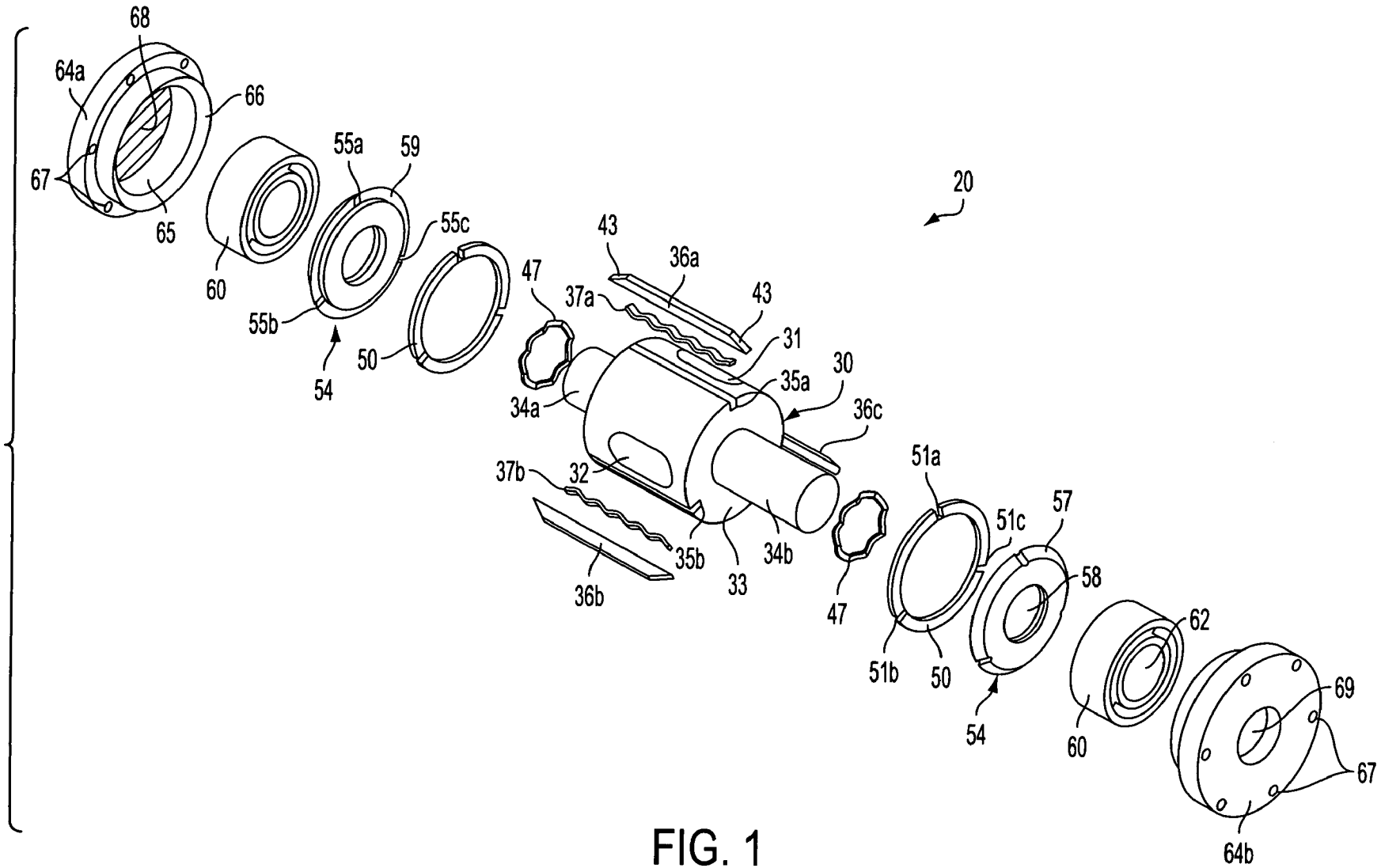
FIG. 1 is an exploded view of a valve body and an interlocking sealing mechanism provided in accordance with principles of the present invention.

Referring now to FIG. 1, a first embodiment of a semi-rotating valve provided in accordance with principles of the present invention is described. Semi-rotating valve 20 of FIG. 1 may be an intake valve and/or an exhaust valve of an internal combustion engine. In a preferred embodiment, the configuration of the intake valve and the exhaust valve are substantially identical. When referring to figures hereinbelow that discuss the use of both an intake valve and an exhaust valve, the intake valve will be referred to generally as "intake valve 20," while the exhaust valve will be referred to generally as "exhaust valve 120," although each valve preferably is provided in accordance with semi-rotating valve 20 of FIG. 1.

In FIG. 1, semi-rotating valve 20 comprises cylindrical valve body 30, which preferably comprises central region 33 having a first diameter, and preferably comprises first and second reduced diameter valve shaft regions 34*a* and 34*b*. Valve body 30 further comprises first side port 31 disposed in a first lateral surface of the valve body, and second side port 32 disposed in a second lateral surface. Passage 76 (see FIGS. 3A–3C) extends between first side port 31 and second side port 32, thereby enabling fluid to pass through valve body 30.

Referring still to FIG. 1, semi-rotating valve 20 further comprises an interlocking sealing mechanism configured to seal the valve assembly in both radial and longitudinal directions. The interlocking sealing mechanism preferably comprises side seals 36*a*–36*c*, lock ring seals 50, tapered seals 54, and end seals 64*a* and 64*b*, although greater or fewer seals may be employed. As depicted, three side seals 36*a*–36*c* are employed, although it will be apparent to one skilled in the art that greater or fewer side seals may be used.

As depicted in FIG. 1, a first set of seals is disposed over valve shaft region 34*a*, and a second, preferably symmetrical set of seals is disposed over valve shaft region 34*b*. Unless otherwise noted, symmetrical seal components will be referred to using the same numerical references.

Side seals 36*a*–36*c* preferably comprise tapered ends 43, as depicted in FIG. 1. Side seals 36*a*–36*c* are configured to be at least partially seated within respective grooves 35*a*–35*c* of semi-rotating valve body 30. In a preferred embodiment, springs 37*a*–37*c* are disposed within respective grooves 35*a*–35*c* and beneath respective side seals 36*a*–36*c*. In operation, springs 37*a*–37*c* cause side seals 36*a*–36*c* to be biased in a radially outward direction, thereby enhancing radial sealing characteristics of semi-rotating valve 20 when valve body 30 and side seals 36*a*–36*c* are disposed within valve housing 93 (see FIG. 3).

Figure 2B:
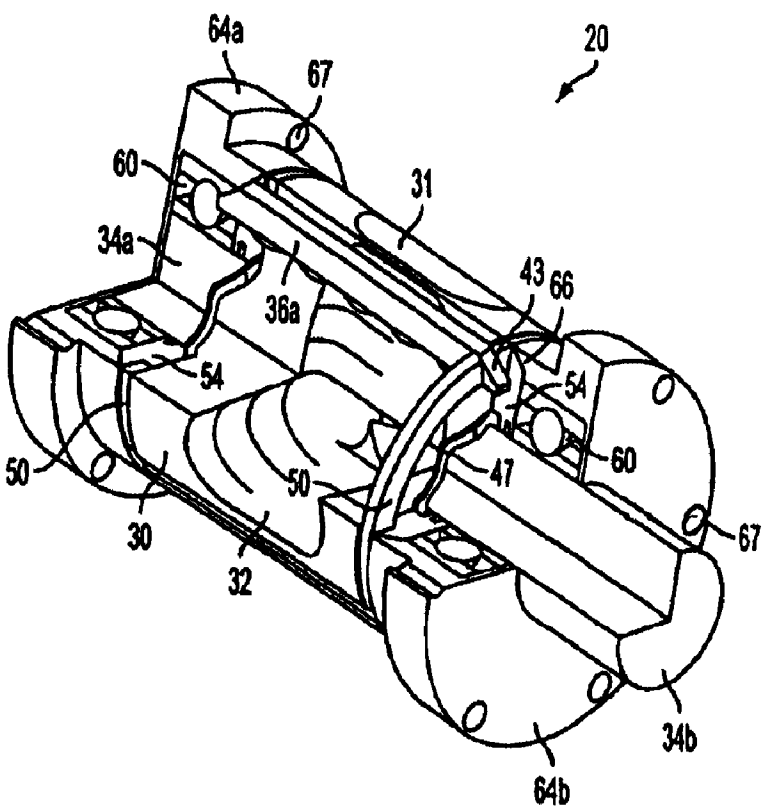
FIGS. 2A–2B are, respectively, a perspective view and a cut-away view of the apparatus of FIG. 1 depicted in an assembled state.

The interlocking sealing mechanism of semi-rotating valve 20 further preferably comprises lock ring seals 50 and tapered seals 54. Each lock ring seal 50 is configured to be seated in recess 59 of tapered seal 54. Each lock ring seal 50 comprises cavities 51*a*–51*c*, which correspond to grooves 35*a*–35*c* of valve body 30. Accordingly, end regions of side seals 36*a*–36*c* may be seated within cavities 51*a*–51*c* of lock ring seals 50 when valve 20 is assembled, as shown in FIG. 2B. Similarly, each tapered seal 54 comprises cavities 55*a*–55*c*, which correspond to grooves 35*a*–35*c* of valve body 30 and allow the end regions of side seals 36*a*–36*c* to further be seated within cavities 55*a*–55*c* in an assembled state.

In the assembled state, first and second bearings 60 are configured to be seated within respective bearing housings 65 formed in end seals 64*a* and 64*b*, as shown in FIG. 2B. End seals 64*a* and 64*b* preferably comprise plurality of bolt holes 67, which allow each end seal to be coupled to valve body 92, as depicted in FIGS. 5–7 and FIG. 9 hereinbelow.

Figure 2A:
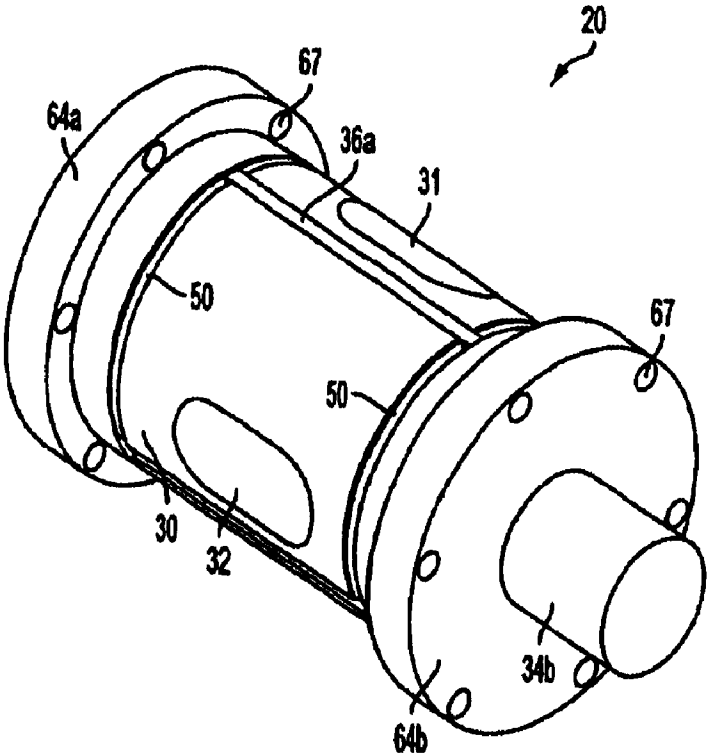

End seal 64*a* comprises back wall 68, while end seal 64*b* comprises a back wall having central bore 69, as shown in FIG. 1. Valve shaft region 34*b* of valve body 30 is configured to be disposed through lock ring seal 50, central bore 58 of tapered seal 54, central bore 62 of bearing 60, and central bore 69 of end seal 64*b*. Valve shaft region 34*b* extends through bore 69 of end seal 64*b* in the assembled state, as shown in FIGS. 2A–2B.

Valve shaft region 34*a* of valve body 30 preferably has a shorter longitudinal length than valve shaft region 34*b*. Accordingly, valve shaft region 34*a* is configured to be disposed through lock ring seal 50, central bore 58 of tapered seal 54 and central bore 62 of bearing 60. Valve shaft region 34*a* does not extend fully through end seal 64*a*, but rather abuts back wall 68 of end seal 64*a*, as shown in FIG. 2B.

Each tapered seal 54 comprises tapered edge 57, which is configured to sealingly engage tapered rings 66 of end seals 64*a* and 64*b* in the assembled state (see FIG. 2B). Further, tapered ends 43 of side seals 36*a*–36*c* preferably are configured to engage tapered rings 66 of end seals 64*a* and 64*b* in the assembled state.

In a preferred embodiment, first and second circular springs 47 are disposed over valve shaft regions 34*a* and 34*b*, as depicted in FIG. 1. Each circular spring 47 is disposed between the central section of valve body 30 and a respective tapered seal 54. Circular springs 47 are configured to urge the respective tapered seals 54 in a longitudinal direction away from the central section of valve body 30, thereby enhancing longitudinal sealing characteristics associated with the valve.

As described hereinabove, the interlocking sealing mechanism of semi-rotating valve 20 is configured to seal the valve assembly in both radial and longitudinal directions. Advantageously, the interlocking sealing mechanism employs relatively few seal components, relative to previously known sealing mechanisms. Moreover, it is expected that the interlocking characteristics of the seals, including the manner in which various tapered regions mate together, is expected to further improve sealing capabilities during operation.

Figure 3A:
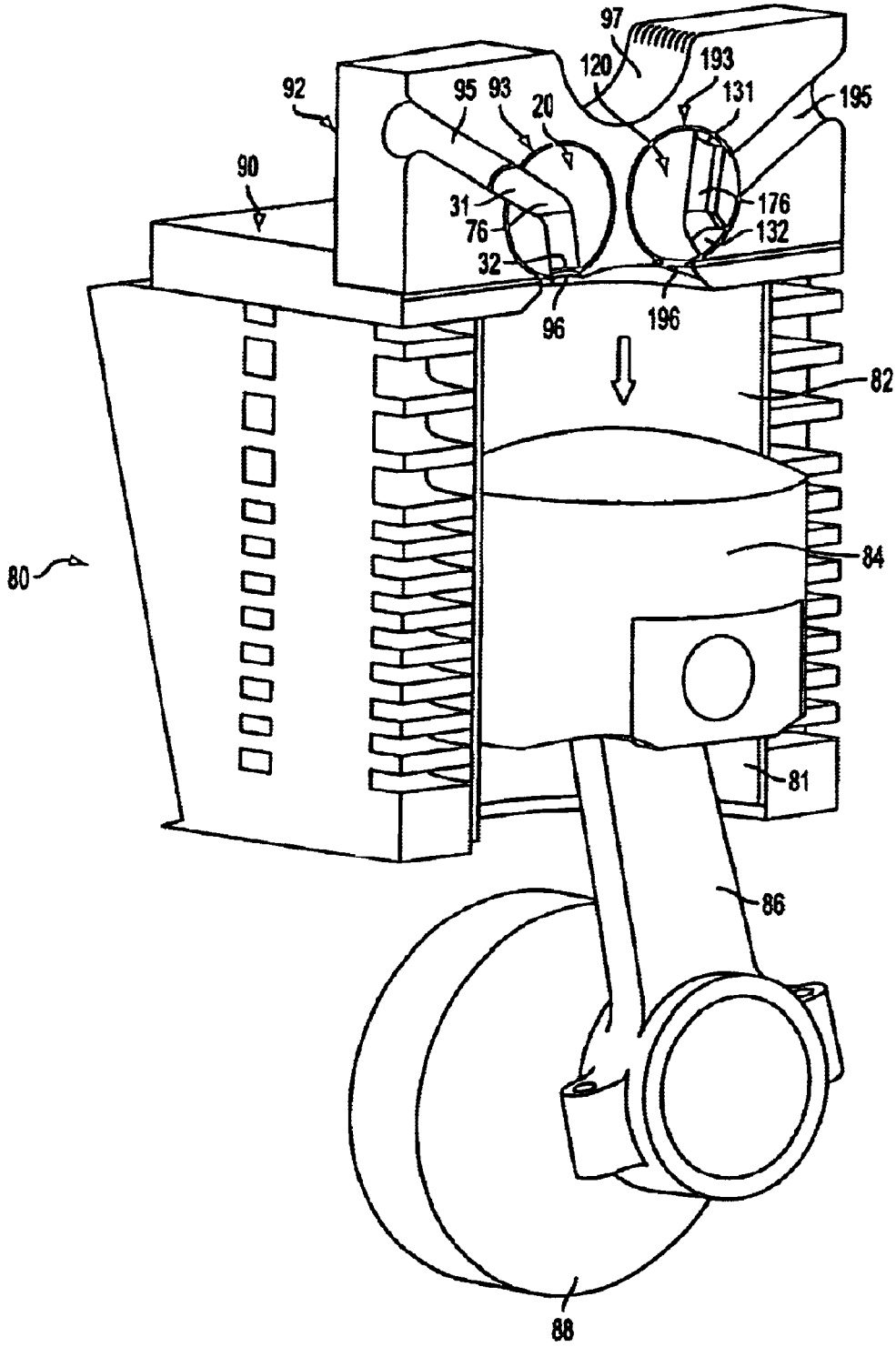
FIGS. 3A–3C are, respectively, side sectional views of a semi-rotating valve assembly according to the present invention during an intake stroke, a compression or power stroke, and an exhaust stroke.
Figure 3B:
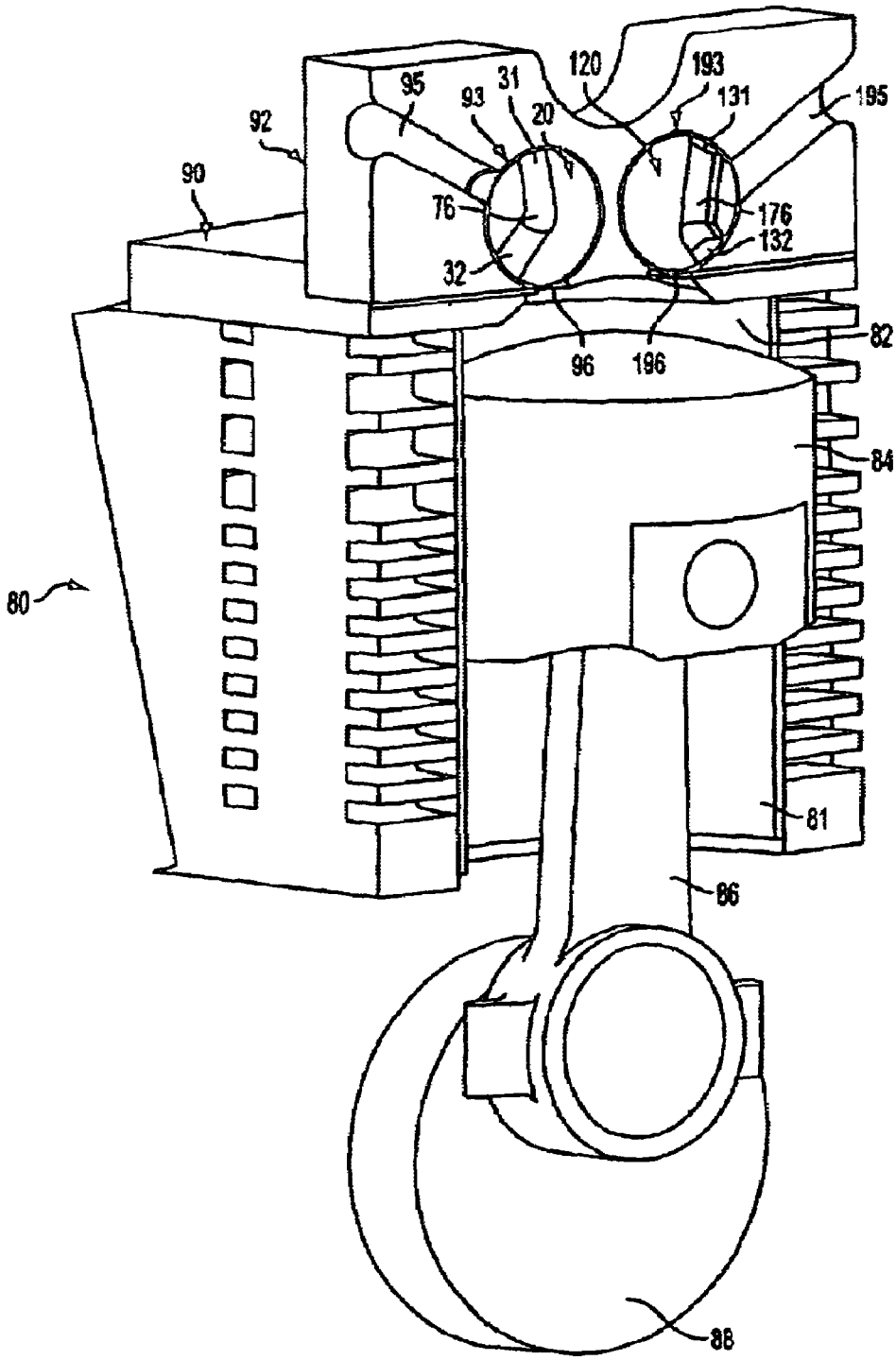
Figure 3C:
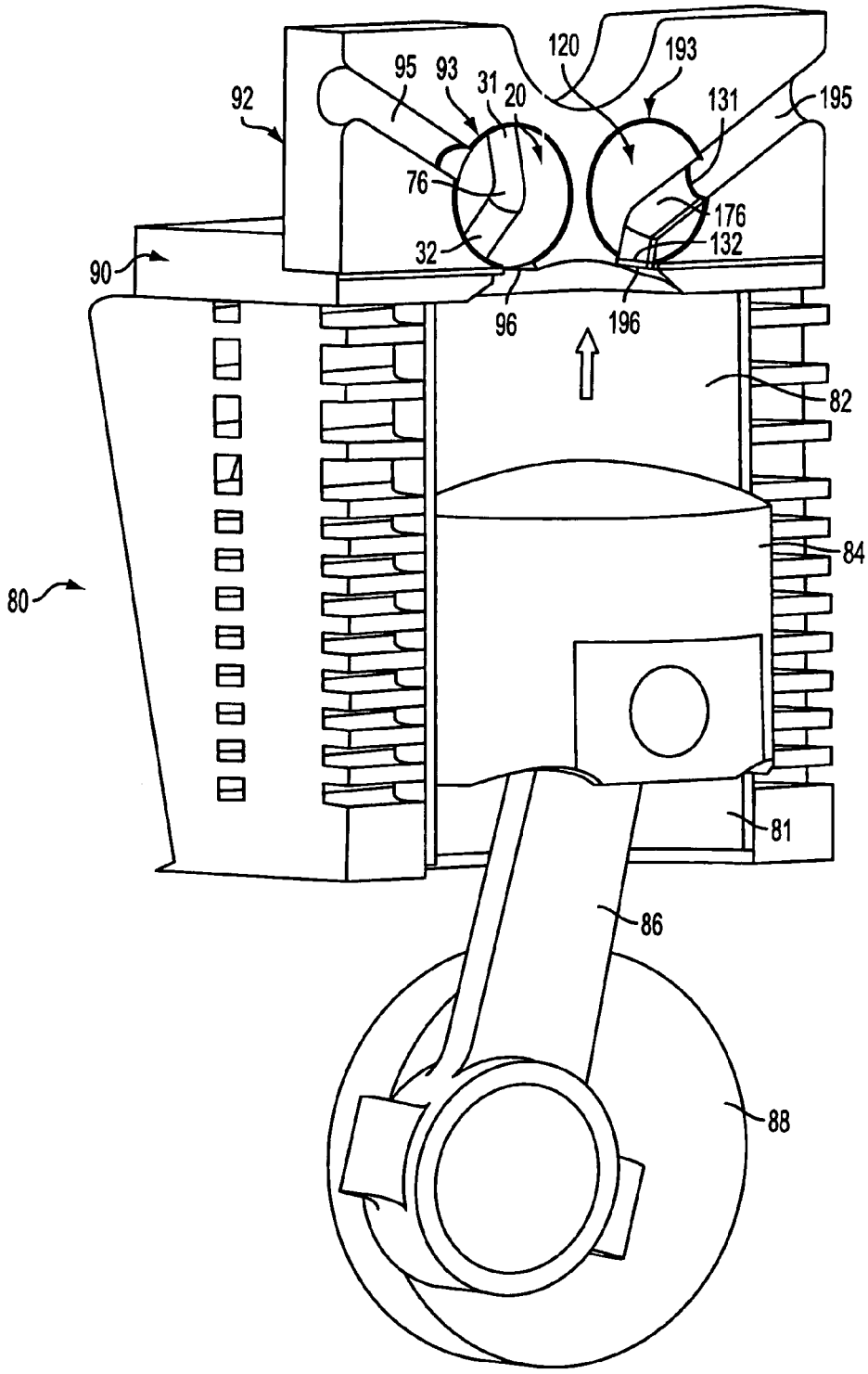

Referring now to FIGS. 3A–3C, a preferred method of using semi-rotating valve assembly 20 of FIGS. 1–2 to control flow into and out of a cylinder of an internal combustion engine is described. As noted hereinabove, semi-rotating valve 20 of FIG. 1 may be used as an intake valve and/or an exhaust valve of an internal combustion engine. In a preferred embodiment, the configurations of the intake valve and the exhaust valve are substantially identical. Accordingly, in FIGS. 3A–3C, an intake valve of the present invention will be referred to generally as "intake valve 20," while an exhaust valve will be referred to generally as "exhaust valve 120." Further, with respect to all embodiments hereinbelow, like numerical components of intake valve 20 will correspond to like numerical components of exhaust valve 120, e.g., first side port 31 of intake valve body 30 will correspond to first side port 131 of exhaust valve body 130, and so forth.

In FIG. 3A, engine 80 comprises cylinder 81, combustion chamber 82 and piston 84, which is coupled to crankshaft 88 via connecting rod 86. Engine 80 further comprises cylinder head 90 and valve body 92, as shown in FIG. 3A. Valve body 92 may be provided as a modular component that is disposed atop cylinder head 90 or, alternatively, valve body 92 may be formed as an integrated component, i.e., formed as a unit with cylinder head 90.

Figure 4A:
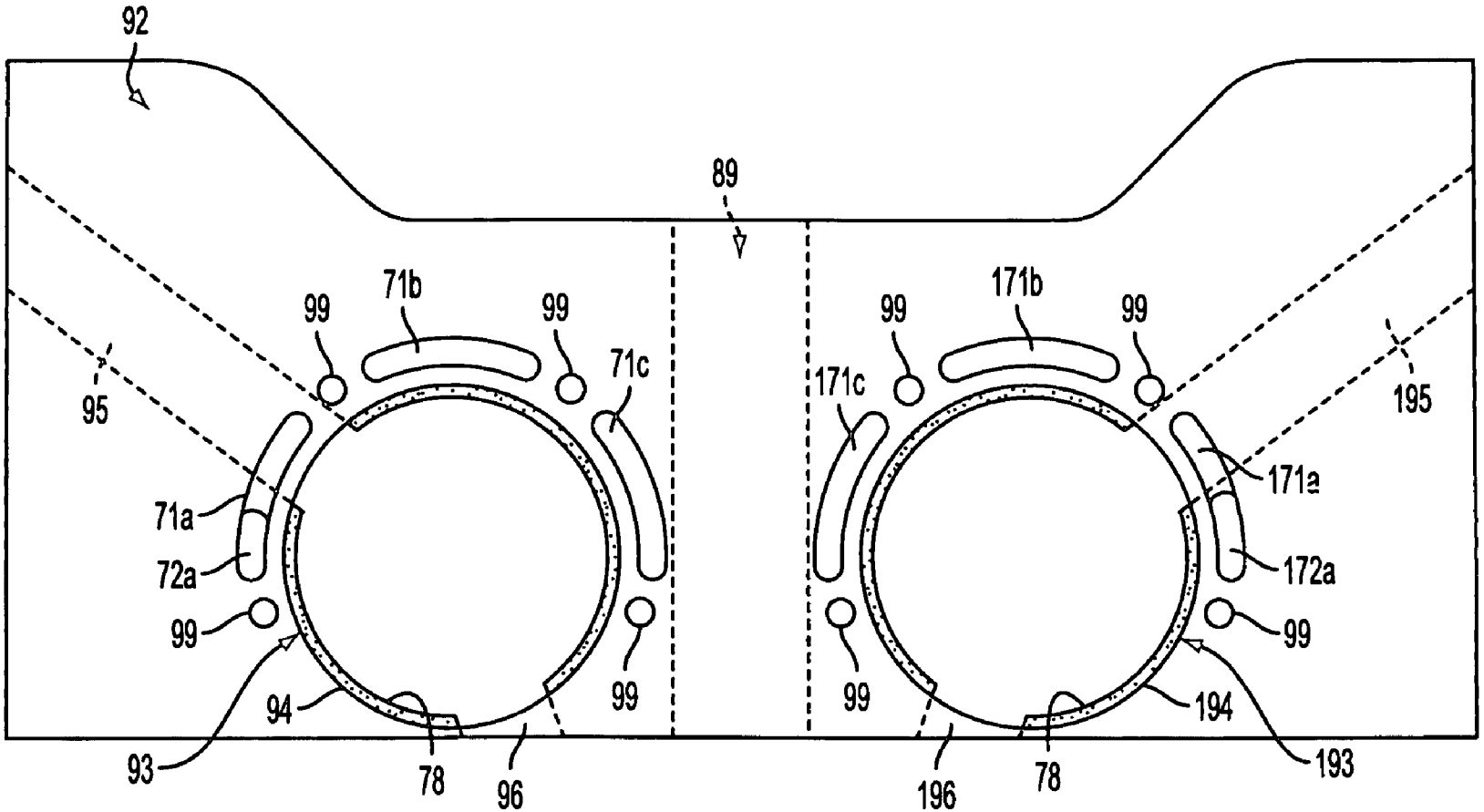
FIGS. 4A–4B are, respectively, a side sectional view and an isometric view of a means for cooling that may be used in conjunction with a semi-rotating valve assembly of the present invention.

In a preferred embodiment of the present invention, valve body 92 comprises first cylindrically-shaped bore 94 that defines intake valve housing 93, as shown in FIG. 4A. An inner diameter of cylindrically-shaped bore hole 94 is slightly larger than an outer diameter of central region 33 of intake valve body 30. Accordingly, intake valve body 30 is configured to rotate with respect to intake valve housing 93. Valve body 92 further comprises second cylindrically-shaped bore 194 that defines exhaust valve housing 193, as shown in FIG. 3A and FIG. 4A. Exhaust valve body 130 similarly is configured for partial rotation with respect to exhaust valve housing 193.

Referring still to FIG. 3A, valve body 92 further preferably comprises intake passage 95 and exhaust passage 195, which are coupled to cylindrically-shaped bores 94 and 194 of intake valve housing 93 and exhaust valve housing 193, respectively. Intake passage 95 and exhaust passage 195 may be formed, for example, by drilling into valve body 92, or by other techniques that are per se known in the art.

Figure 4B:
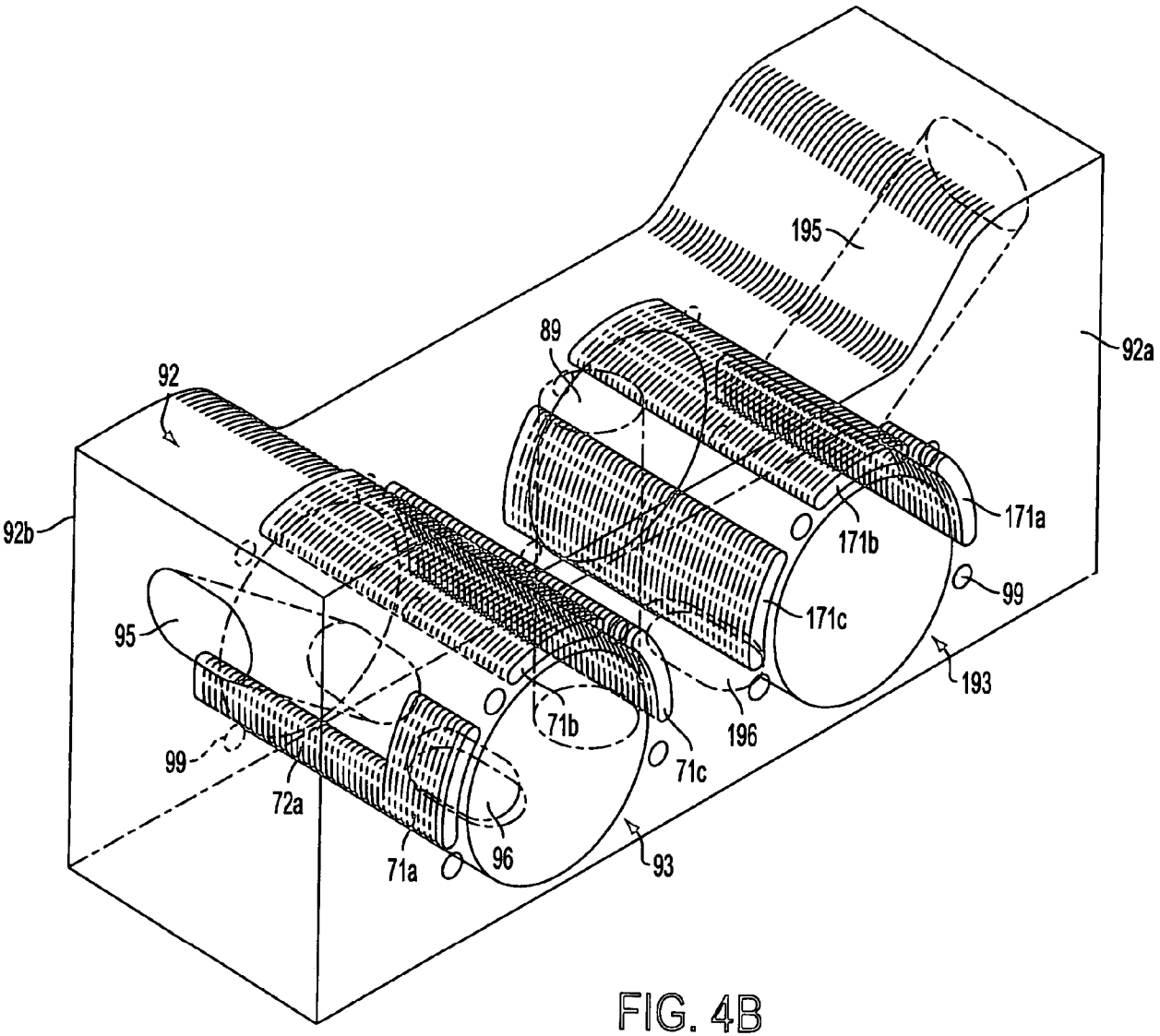

Valve body 92 further preferably comprises intake port 96 and exhaust port 196, which preferably are formed as holes bored into valve body 92, as depicted in FIG. 3A and FIGS. 4A–4B. Intake port 96 is disposed between combustion chamber 82 and cylindrically-shaped bore 94 of intake valve housing 93, while exhaust port 196 is disposed between combustion chamber 82 and cylindrically-shaped bore 194 of exhaust valve housing 193.

As will be described in greater detail hereinbelow with respect to FIGS. 5–10, various means for actuating may be mounted on cylinder head 90 and/or valve body 92 to control actuation of intake valve 20 and exhaust valve 120 during operation of engine 80. In the embodiments of FIGS. 5–9, cylinder head 90 comprises slot 91 (see, for example, FIG. 5A), which allows a timing belt (not shown) to be operatively coupled between crankshaft 88 and the means for actuating.

Referring still to FIGS. 3A–3C, operation of engine 80, when used in conjunction with semi-rotating intake and exhaust valves 20 and 120 of the present invention, is described. While operation of engine 80 is described based on the four stroke Otto cycle, it will be apparent to one skilled in the art that semi-rotating valves 20 and 120 of the present invention may be employed in other engines that operate on other cycles, such as a two-stroke cycle.

In FIG. 3A, operation of engine 80 during an intake stroke is depicted. During the intake stroke, intake valve 20 is rotated to an open state whereby first side port 31 of intake valve body 30 at least partially overlaps with intake passage 95, and second side port 32 of intake valve body 30 at least partially overlaps with intake port 96. Accordingly, intake passage 95 is placed in fluid communication with combustion chamber 82 via passage 76 of intake valve body 30.

At this time, a mixture of air and fuel may be directed into combustion chamber 82 of engine 80 via intake passage 95, passage 76, and intake bore 96. As will be apparent to one skilled in the art, fuel alternatively may be directly injected into combustion chamber 82 using a direct fuel injection port (not shown), while air is still provided via intake passage 95, passage 76, and intake bore 96.

As will be described hereinbelow with respect to FIGS. 5–10, any number of means for actuating, coupled to valve shaft region 34*b*, may be employed to cause valve body 30 to partially rotate with respect to intake valve housing 93. In accordance with one aspect of the present invention, intake valve body 30 rotates less than 360 degrees with respect to intake valve housing 93 to cause first and second side ports 31 and 32 to at least partially overlap with intake passage 95 and intake port 96, respectively, in the open state.

During the intake stroke of engine 80, exhaust valve 120 is provided in a closed state, whereby first side port 131 of exhaust valve body 130 does not overlap with exhaust passage 195, and second side port 132 of exhaust valve body 130 does not overlap with exhaust port 196, as shown in FIG. 3A. Accordingly, exhaust valve 120 inhibits fluid communication between combustion chamber 82 and exhaust passage 195 during the intake stroke.

Referring now to FIG. 3B, after the intake stroke occurs, intake valve body 30 is rotated less than 360 degrees to a closed state via the means for actuating employed, for example, as described hereinbelow with respect to FIGS. 5–10.

In the closed state, intake valve body 30 is positioned such that first side port 31 does not overlap with intake passage 95, and second side port 32 does not overlap with intake port 96, thereby inhibiting fluid communication between combustion chamber 82 and intake passage 95, as depicted in FIG. 3B.

To close intake valve 20, intake valve body 30 is rotated in a direction that is the opposite direction used to open intake valve 20. For example, if a clockwise rotation of less than 360 degrees is used to open the valve, as depicted in FIG. 3A, then a counterclockwise motion of less than 360 degrees is used to close the valve, as depicted in FIG. 3B.

Referring still to FIG. 3B, with intake valve body 30 in the closed state, a compression stroke occurs, whereby piston 84 compresses the mixture of fuel and air to increase the pressure in cylinder 81. Just before piston 84 reaches the top of cylinder 81, a spark provided by the spark plug (not shown) ignites the mixture, causing the piston to be forced down the cylinder in the power stroke. Both intake valve 20 and exhaust valve 120 remain in their respective closed states during the power stroke.

After the power stroke, an exhaust stroke occurs whereby the means for actuating employed causes exhaust valve body 130 to be partially rotated with respect to exhaust valve housing 193, thereby forcing burned gases out of cylinder 81. The exhaust stroke of engine 80 is depicted in FIG. 3C. In the exhaust stroke, intake valve 20 remains in a closed state, while exhaust valve body 130 is partially rotated to an open state. In the open state, first side port 131 of exhaust valve body 130 at least partially overlaps with exhaust passage 195, and second side port 132 of exhaust valve body 130 at least partially overlaps with exhaust port 196, thereby allowing fluid communication between combustion chamber 82 and exhaust passage 195 via passage 176, as shown in FIG. 3C. As will be apparent to one skilled in the art, after the exhaust stroke is completed, the four strokes of engine 80 then are repeated continuously during the operation of the engine.

Advantageously, in accordance with one object of the present invention, the use of semi-rotating intake and exhaust valves is expected to significantly reduce friction, heat and wear imposed on the intake and exhaust valves, as well as related sealing components. This is primarily because the valve bodies are configured to rotate less than 360 degrees with respect to their respective valve housings. As depicted in FIGS. 3A–3C, both the intake valve body and the exhaust valve body are only required to rotate between about 20 and 90 degrees in each direction to transition between open and closed states, although more or less rotation may be tolerated. Moreover, when intake valve 20 and exhaust valve 120 are in their respective closed states, each valve body is allowed to rest for a period of time, thereby further reducing friction, heat and wear.

Additionally, in accordance with another object of the present invention, the interlocking sealing mechanisms of intake valve 20 and exhaust valve 120 are expected to provide improved sealing capabilities during operation. For example, when there is an increased pressure in the combustion chamber, the interlocking components form a tight seal to prevent leakage in both radial and longitudinal directions, in part due to the manner in which various tapered regions mate together. Because the interlocking sealing mechanisms form a tight seal, power and efficiency may be improved, while emissions may be reduced. Moreover, the interlocking sealing mechanisms may be configured to assume relaxed states when significant pressures from the combustion chamber are no longer imposed, thereby further reducing rates of wear.

Referring now to FIGS. 4A–4B, further features of valve body 92 of FIGS. 3A–3C are described. Additionally, a means for cooling, which preferably is used in conjunction with a semi-rotating valve of the present invention, also is described in FIGS. 4A–4B.

In a preferred embodiment of the present invention, wear sleeve 78 is disposed between valve body 30 of FIG. 1 and cylindrically-shaped bore 94 of valve housing 93. Wear sleeve 78 is fixedly disposed within bore 94, such that valve body 30 of FIG. 1 rotates with respect to wear sleeve 78. Wear sleeve 78 comprises first and second apertures that overlay intake passage 95 and intake bore 96, respectively, as depicted in FIG. 4A. As will be apparent to one skilled in the art, wear sleeve 78 may comprise any suitable material configured to reduce friction and wear imposed on valve body 30 and components of the interlocking sealing mechanism. A similar or identical wear sleeve 78 also preferably is used in conjunction with exhaust valve 120, as depicted.

In FIGS. 4A–4B, valve body 92 further comprises plurality of bolt holes 99, which correspond to bolt holes 67 of end seals 64*a* and 64*b* of FIG. 1. Bolt holes 99 are disposed in front and rear portions 92*a* and 92*b* of block 92, as depicted in FIG. 4B. Accordingly, end seal 64*a* may be securely coupled to either front portion 92*a* or rear portion 92*b* of block 92, and end seal 64*b* then may be coupled to the other side of block 92.

Block 92 further comprises spark plug housing 89, as shown in FIGS. 4A–4B. As will be apparent to one skilled in the art, a spark plug (not shown) is disposed in spark plug housing 89 facing combustion chamber 82. Spark plug housing 89 may be disposed between intake valve housing 93 and exhaust valve housing 193, as depicted. Alternatively, one or more spark plug housings 89 may be disposed on either side of intake valve housing 93 or exhaust valve housing 193, or at any other suitable location.

Referring still to FIGS. 4A–4B, the semi-rotating valve assembly of the present invention further preferably comprises at least one cooling passage 71 disposed in valve body 92. In FIGS. 4A–4B, three cooling passages 71*a*–71*c* are depicted extending through valve body 92 in a longitudinal direction, i.e., in a direction from front portion 92*a* of block 92 to rear portion 92*b*. The cooling passages are disposed substantially adjacent to intake valve housing 93 and exhaust valve housing 193, and preferably at least partially surrounding the valve housings.

In operation, a suitable coolant may be circulated through intake cooling passages 71*a*–71*c*, and similarly through exhaust cooling passages 171*a*–171*c*. Coolant may be continuously recirculated through the cooling passages during operation of engine 80. Advantageously, circulation of coolant through cooling passages 71*a*–71*c* and 171*a*–171*c* is expected to carry considerable heat away from intake valve body 30 and exhaust valve body 130, respectively. Furthermore, the provision of cooling passages 171*a*–171*c* is expected to facilitate cooler exhaust temperatures and, therefore, lower NOx emissions may be achieved.

It will be apparent to one skilled in the art that, while three cooling passages are depicted partially surrounding each valve housing, greater or fewer cooling passages may be employed. Also, the circulation capacity of the cooling passages, along with the speed of circulation, may vary with various engine design requirements, such as displacement, compression ratio and aspiration.

Furthermore, the configuration of cooling passages 71*a*–71*c* may be varied, for example, cooling passage 71*a* may be provided with reduced area section 72*a* to permit circulation of coolant around intake passage 95. It will be apparent to one skilled in the art that the exact positioning of the cooling passages within valve body 92 may be varied to accommodate various design requirements.

Figure 5A:
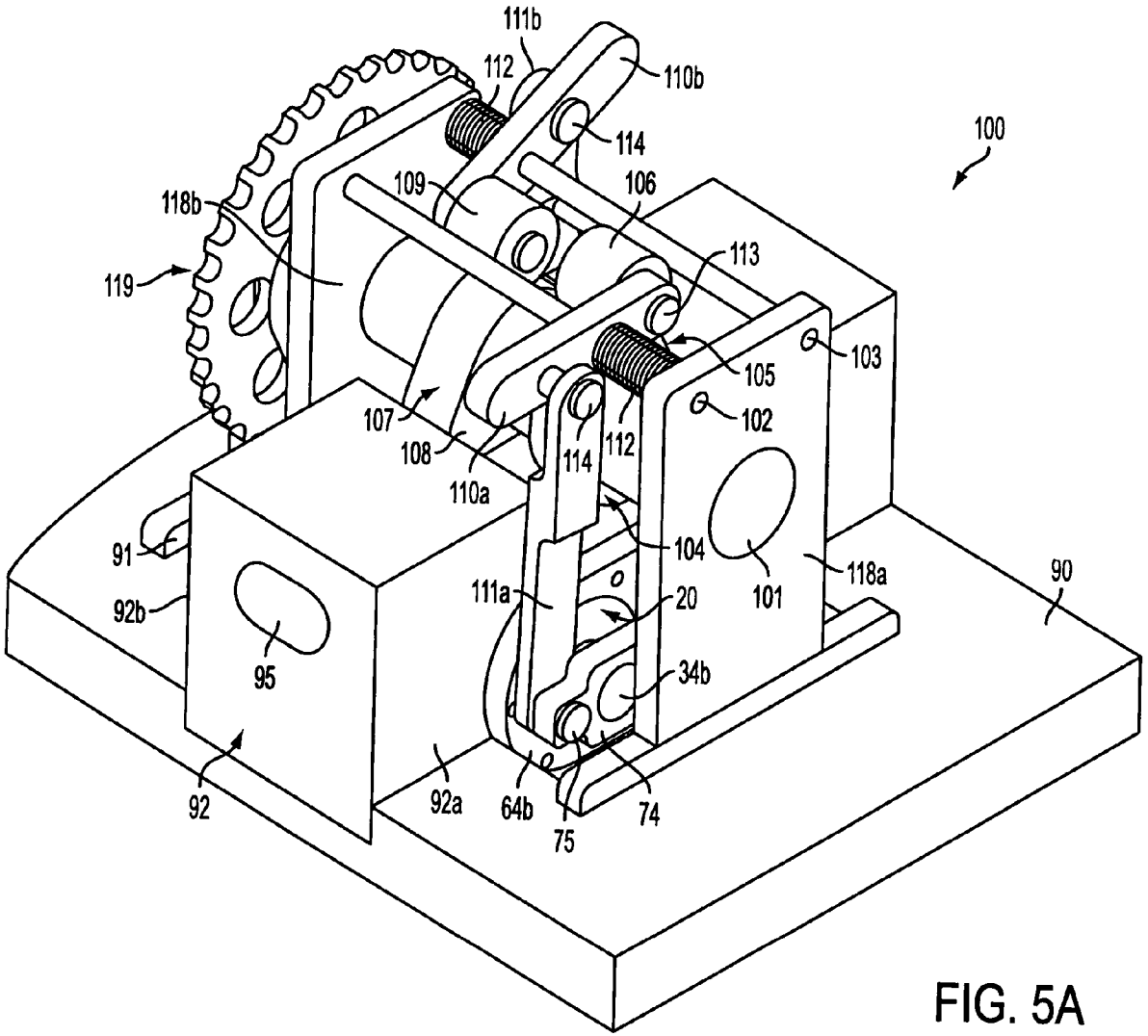
FIGS. 5A–5B are, respectively, perspective views of a means for actuating depicted during the intake stroke of FIG. 3A and during the exhaust stroke of FIG. 3C.
Figure 5B:
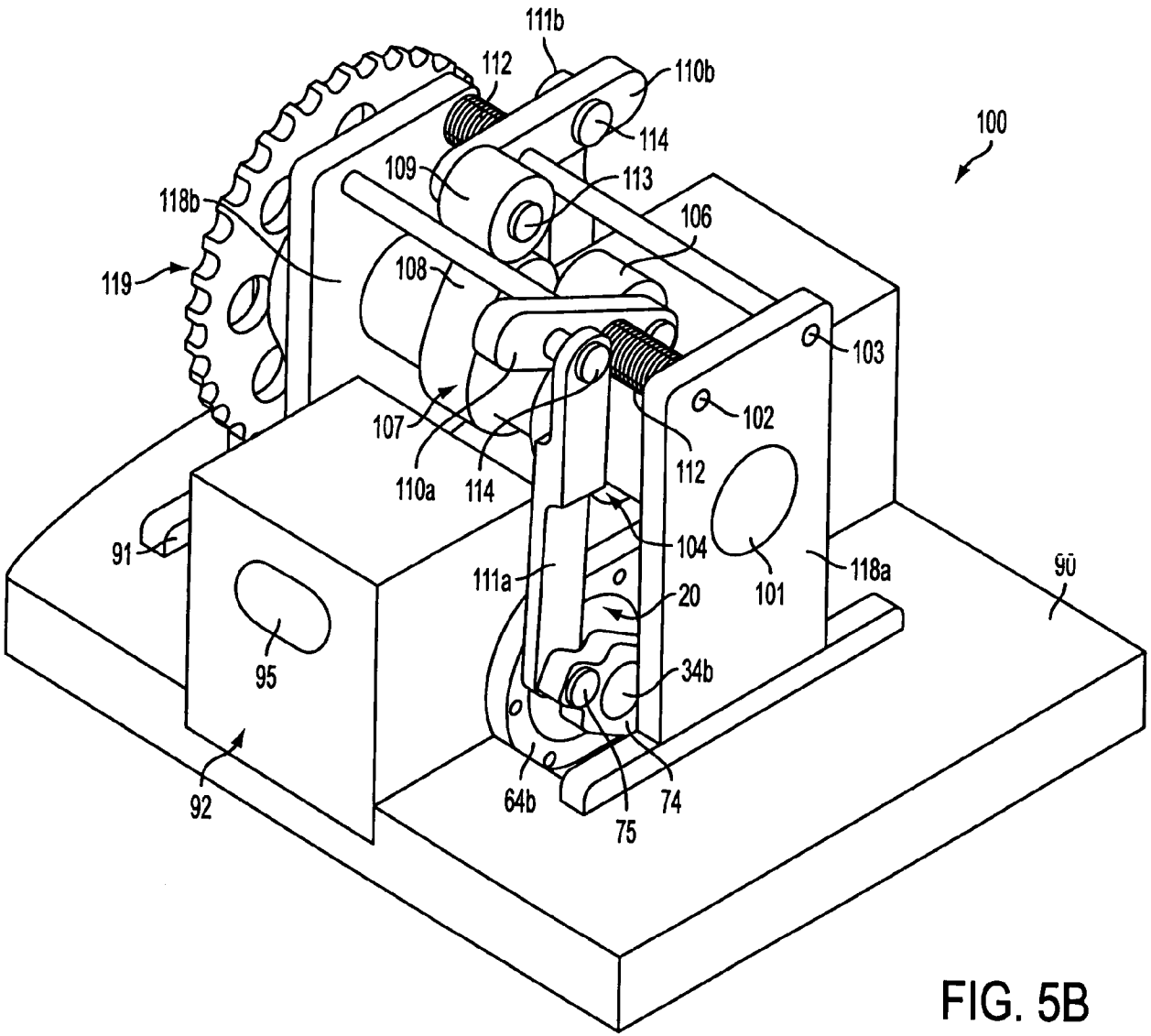

Referring now to FIGS. 5A–5B, a first means for actuating that may be used to effect partial rotation of semi-rotating valves 20 and 120 of FIGS. 3A–3C, in accordance with principles of the present invention, is described. As will be apparent to one skilled in the art, a cylinder head cover (not shown) may be employed to cover components of means for actuating 100 during operation.

In the embodiment of FIG. 5A, means for actuating 100 comprises camshaft 101. A first end of camshaft 101 is coupled to first support member 118*a*, while a second end of camshaft 101 is disposed through a bore of second support member 118*b* and coupled to gear 119. Gear 119 is operatively coupled to crankshaft 88 of FIGS. 3A–3C via a timing belt (not shown) disposed through slot 91 of cylinder head 90. Accordingly, motion from the rotation of crankshaft 88 is translated into rotational motion of camshaft 101 via the timing belt and gear 119.

As depicted in FIGS. 5A–5B, and as will be described in further detail hereinbelow, a first set of actuation components is operatively coupled between camshaft 101 and intake valve 20. A second set of actuation components is operatively coupled between camshaft 101 and exhaust valve 120.

In a preferred embodiment, the first set of actuation components used to actuate intake valve 20 is identical to the second set of actuation components used to actuate exhaust valve 120. Moreover, actuation of intake valve 20 occurs in a manner substantially identical to actuation of exhaust valve 120. Therefore, in FIGS. 5A–5B, unless otherwise noted, like intake and exhaust actuation components will be referred to using the same numerical references, for simplicity. Further, only the actuation of intake valve 20 will be described in detail.

Finally, it should be noted that, in the embodiments of FIGS. 5–7 and FIG. 9, valve shaft 134*b* of exhaust valve 120 extends beyond rear portion 92*b* of valve body 92. It will be apparent to one skilled in the art that actuation of exhaust valve 120 may occur in a similar or identical manner to actuation of intake valve 20.

Referring back to FIG. 5A, a first rocker arm 110*a* is operatively coupled between camshaft 101 and intake valve body 30, while a second rocker arm 110*b* is operatively coupled between camshaft 101 and exhaust valve body 130. Rocker arms 110*a* and 110*b* have first and second ends and a bore (not shown) that extends laterally through the rocker arms. The bores of rocker arms 110*a* and 110*b* have a diameter that is slightly larger than a diameter of rocker arm shafts 102 and 103, thereby allowing first and second rocker arms 110*a* and 110*b* to be moveably disposed on rocker arm shafts 102 and 103, respectively, as depicted in FIGS. 5A–5B.

The first end of rocker arm 110*a* is coupled to cam follower 106 via pin 113, while the second end of rocker arm 110*a* is coupled to connecting rod 111*a* via pin 114, as shown in FIG. 5A. Similarly, the first end of rocker arm 110*b* is coupled to cam follower 109, while the second end of rocker arm 110*b* is coupled to connecting rod 111*b*.

In a preferred embodiment, connecting rod 111*a* is operatively coupled to valve shaft region 34*b* of intake valve 20 via connecting link 74. Preferably, connecting link 74 is coupled to connecting rod 111*a* using pin 75, as shown in FIG. 5A. Pin 75 converts upwards and downward movements of connecting rod 111*a* into rotational motion of valve body 30 to effect partial rotation of the valve body, as described hereinbelow.

In the schematic of FIG. 5A, actuation assembly 100 is depicted during an intake stroke, whereby intake valve 20 is in an open state and exhaust valve 120 is in a closed state. During the intake stroke, a timing belt (not shown), which is coupled between crankshaft 88 and gear 119, causes rotation of gear 119, which in turn causes rotation of camshaft 101 to the position depicted in FIG. 5A. In this position, lobe 105 of cam 104 rotates to an upward-facing position. Lobe 105 then pushes cam follower 106 in an upward direction during the intake stroke. Upward movement of cam follower 106, which is coupled to rocker arm 110*a*, causes rocker arm 110*a* to rotate about rocker arm shaft 102 such that the first end of the rocker arm moves in an upward direction, and the second end of the rocker arm moves in a downward direction.

The second end of rocker arm 110*a*, which is coupled to connecting rod 111*a*, translates a downward movement to connecting rod 111*a*. Downward movement of connecting rod 111*a* causes a partial rotation of intake valve body 30 via connecting link 74 and pin 75. The partial rotation of intake valve body 30 causes first side port 31 of intake valve body 30 to at least partially overlap with intake passage 95 of valve body 92, as shown in FIG. 3A. Also, the partial rotation of intake valve body 30 causes second side port 32 of intake valve body 30 to at least partially overlap with intake bore 96, thereby allowing combustion chamber 82 to receive a mixture of air and fuel from intake passage 95. It should be noted that, during the intake stroke depicted in FIG. 5A, exhaust valve 120 remains in a closed state.

Referring now to FIG. 5B, actuation assembly 100 is depicted during an exhaust stroke, whereby intake valve 20 is in a closed state and exhaust valve 120 is in an open state. During the exhaust stroke, the timing belt coupled to crankshaft 88 causes rotation of camshaft 101 to the position depicted in FIG. 5B. In this position, lobe 108 of cam 107 rotates to an upward-facing position. Lobe 108 then pushes cam follower 109 in an upward direction. Upward movement of cam follower 109, which is coupled to rocker arm 110*b*, causes rocker arm 110*b* to rotate about rocker arm shaft 103 such that the first end of the rocker arm moves in an upward direction, and the second end of the rocker arm moves in a downward position.

The second end of rocker arm 110*b*, which is coupled to connecting rod 111*b*, translates a downward motion to connecting rod 111*b*, which in turn actuates exhaust valve body 130. Exhaust valve shaft 130 is partially rotated to cause first side port 131 to at least partially overlap with exhaust passage 195 of valve body 92, as shown in FIG. 3C. Also, the partial rotation of exhaust valve body 130 causes second side port 132 to at least partially overlap with exhaust bore 196, thereby forcing burned gases out of cylinder 81 via passage 176, as shown in FIG. 3C.

During the exhaust stroke, depicted in FIG. 5B, means for actuating 100 causes intake valve 120 to remain in a closed state. Specifically, when camshaft 101 is in the position depicted to actuate exhaust valve 120, lobe 105 of cam 104 does not engage cam follower 106. When lobe 105 does not engage cam follower 106, torsional spring 112 causes rocker arm 110*a* to return to the position depicted in FIG. 5B. In this position, connecting rod 111*b* will retain intake valve body 30 in a closed state, as depicted in FIG. 3C.

As described in FIG. 3B hereinabove, intake valve 20 and exhaust valve 120 are both provided in closed states during the compression stroke and power stroke of engine 80. Accordingly, during each of these cycles, the rotation of camshaft 101 does not substantially disturb rocker arms 110*a* and 110*b*. Therefore, a first torsional spring 112 causes rocker arm 110*a* to remain in a position depicted in FIG. 5B, while a second torsional spring 112 causes rocker arm 110*b* to remain in a position depicted in FIG. 5A. This causes both intake valve 20 and exhaust valve 120 to be provided in closed states during the compression and power strokes, as depicted in FIG. 3B.

It will be understood by one skilled in the art that fewer or greater parts may be employed to achieve the actuation results described in FIGS. 5A–5B. Any number of variations in linkages and mechanisms may be provided to cause partial rotation of intake valve body 30 and exhaust valve body 130, according to principles to the present invention. For example, rocker arms 110*a* and 110*b* may be directly coupled to their respective valve bodies 30 and 130, thereby eliminating connecting rods 111*a* and 111*b*. Alternatively, connecting rods 111*a* and 111*b* may be replaced with any type of rocker arm, direct acting cam, lever, chains, gears, belts or other mechanisms.

Figure 6:
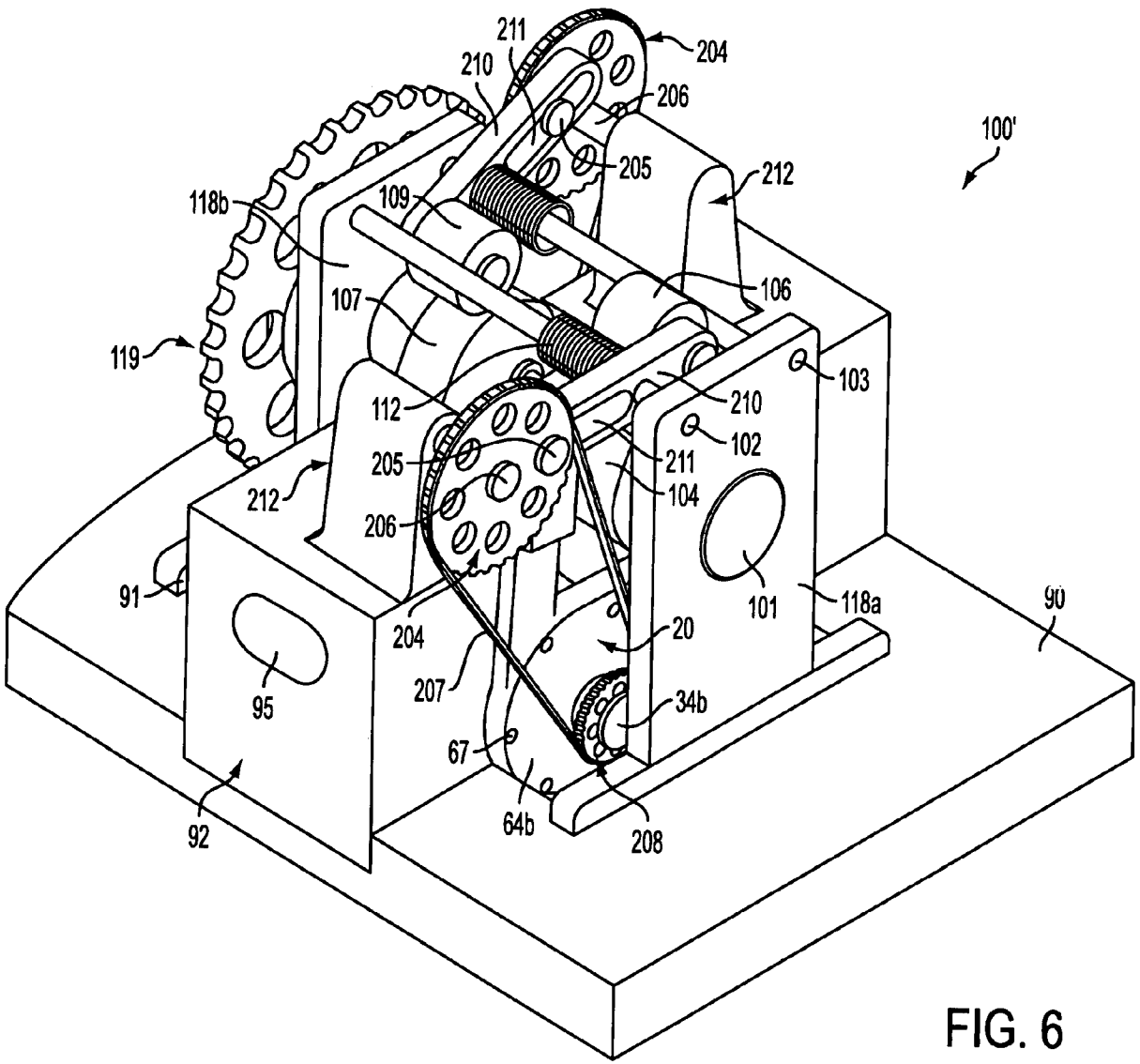
FIG. 6 is a perspective view of an alternative means for actuating depicted during an intake stroke.

Referring now to FIG. 6, an alternative means for actuating, which may be used in conjunction with a semi-rotating valve assembly of the present invention, is described. In FIG. 6, alternative means for actuating 100' actuates intake and exhaust valves 20 and 120 in a manner that is similar to actuation using actuation assembly 100 of FIGS. 5A–5B, with the exception that rocker arms 110*a* and 110*b* have been replaced with first and second rocker arms 210 having slots 211. Additionally, connecting rods 111*a* and 111*b* of FIGS. 5A–5B have been replaced with sprocket and linkage assemblies, as described hereinbelow, to effect actuation of intake and exhaust valves 20 and 120. In the embodiment of FIG. 6, actuation of intake and exhaust valves 20 and 120 occurs in a substantially identical manner, and therefore, only actuation of intake valve 20 will be described in detail.

The first rocker arm 210, which is coupled to intake valve 20, has first and second ends and a bore (not shown) that extends laterally through the rocker arm. The bore has a diameter that is slightly larger than an outer diameter of rocker arm shaft 102, thereby allowing rocker arm 210 to be moveably disposed on rocker arm shaft 102.

Alternative actuation assembly 100' further comprises first sprocket 204 and second sprocket 208. Linkage 207, for example, a chain or belt, is coupled between first and second sprockets 204 and 208. As will be understood by one skilled in the art, first and second sprockets 204 and 208 have a plurality of teeth configured to engage a plurality of perforations of linkage 207, such that rotational motion of first sprocket 204 is translated into rotational motion of second sprocket 208.

Sprocket support member 212, which preferably is disposed atop valve body 92, comprises sprocket support rod 206 extending therefrom. A central bore of first sprocket 204 is disposed through sprocket support rod 206, thereby allowing first sprocket 204 to rotate on the sprocket support rod. Second sprocket 208 may be directly coupled to valve shaft region 34*b* of intake valve 20, as shown in FIG. 6.

Rocker arm 210 comprises slot 211, which is disposed through the second end of the rocker arm, as depicted in FIG. 6. Pin 205 is coupled between an outer region of first sprocket 204 and rocker arm 210, as depicted in FIG. 6, and is configured for sliding movement within slot 211.

In a preferred method of operation, camshaft 101 rotates in a manner described in detail hereinabove with respect to FIGS. 5A–5B. Therefore, during an intake stroke of engine 80, lobe 105 of cam 104 causes an upward movement of cam follower 106. Upward movement of cam follower 106 causes the first end of rocker arm 210 to move in an upward direction, while the second end of rocker arm 210 is urged in a downward direction. Movement of the second end of rocker arm 210 in a downward direction causes rotation of first sprocket 204, i.e., via pin 205. During this time, pin 205 is configured to slide within slot 211 of rocker arm 210, as needed.

Rotation of first sprocket 204 causes rotation of second sprocket 208 via linkage 207. Second sprocket 208, which is coupled to valve shaft region 34*b*, then causes partial rotation of intake valve body 30 within valve housing 93 (see FIG. 3A). The partial rotation of intake valve body 30 causes first side port 31 of intake valve body 30 to at least partially overlap with intake passage 95 of valve body 92, as depicted in FIG. 3A. Also, the partial rotation of intake valve body 30 causes second side port 32 of intake valve body 30 to at least partially overlap with intake bore 96, thereby allowing combustion chamber 82 to receive a mixture of air and fuel from intake passage 95.

After the intake stroke, and when cam lobe 105 no longer significantly urges cam follower 106 in an upward direction, torsional spring 112 causes rocker arm 210 to return to a relaxed, closed position. When rocker arm 210 is in the closed position, first and second sprockets 204 and 208 are rotated to a position that causes intake valve body 30 to be in the closed state, for example, as shown in FIGS. 3B–3C hereinabove.

As will be apparent to one skilled in the art, a timing sequence may be arranged so that lobe 108 of cam 107 urges cam follower 109 in an upward direction during an exhaust stroke. When cam follower 109 is urged in the upward direction, the rocker arm coupled to exhaust valve 120 is actuated to cause partial rotation of exhaust valve body 130, in a manner similar to actuation of intake valve 20, as described hereinabove.

Figure 7:
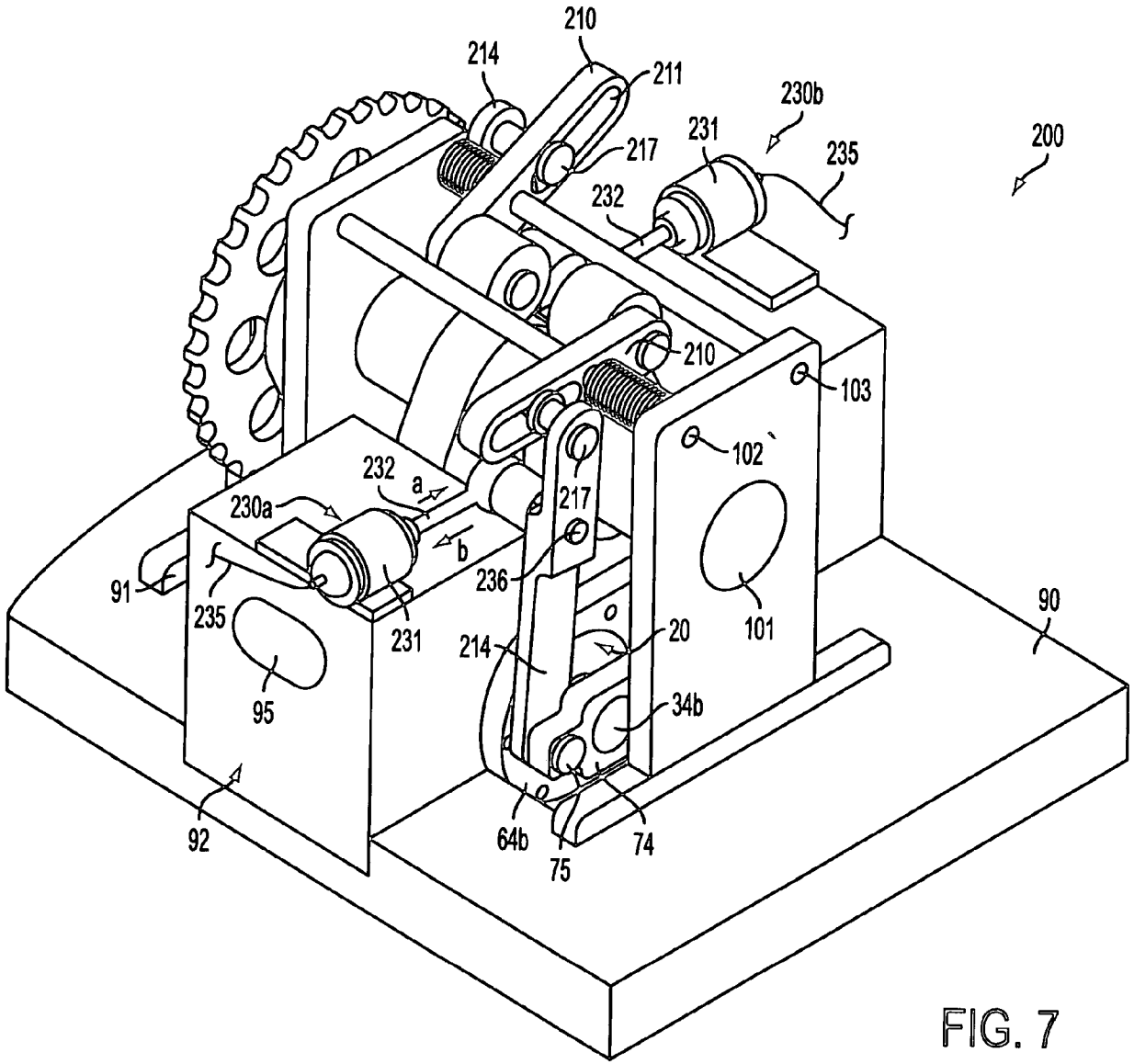
FIG. 7 is a perspective view of an actuation assembly comprising a means for actuating and a means for varying an aperture size associated with a semi-rotating valve of the present invention.

Referring now to FIG. 7, a further alternative embodiment of the present invention is described, whereby a means for varying an aperture size associated with a semi-rotating valve is used in conjunction with a means for actuating the valve. As will be described hereinbelow, the means for varying an aperture size advantageously may be used to compensate for differences in engine speed, thereby improving efficiency of an engine and reducing fuel consumption and emissions.

In FIG. 7, means for actuating 200 comprises camshaft 101, which preferably is provided in accordance with camshaft 101 of FIGS. 5–6. Accordingly, camshaft 101 comprises first cam 104 having lobe 105, and second cam 107 having lobe 108 (see, e.g., FIGS. 5A–5B). Means for actuating 200 further comprises first and second rocker arms 210, which are provided substantially in accordance with rocker arms 210 of FIG. 6. The first rocker arm 210 is operatively coupled to intake valve 20, while the second rocker arm 210 is operatively coupled to exhaust valve 120.

In the embodiment of FIG. 7, means for varying 230*a* and 230*b* are used in conjunction with means for actuating 200. Means for varying 230*a* and 230*b* are configured to vary an aperture size associated with intake valve 20 and exhaust valve 120, respectively. Since components of means for varying 230*a* and 230*b* preferably are identical, only actuation of intake valve 20, using means for actuating 200 and means for varying 230*a*, will be described in detail in the embodiment of FIG. 7.

As used herein, the term "aperture" generally refers to an opening caused by an at least partial overlap of first side port 31 with intake passage 95, and/or an opening caused by an at least partial overlap of second side port 32 with intake port 96. For example, referring to FIG. 3A, a relatively large aperture size associated with intake valve 20 is depicted, and therefore, flow into cylinder 81 may be increased. If desired, only a partial overlap of first side port 31 and intake passage 95 may be achieved, thereby providing a reduced intake aperture size to reduce flow into cylinder 81.

In the embodiment of FIG. 7, means for varying 230*a* comprises an actuator embodied as a solenoid 231, which is coupled to rod 232. As will be apparent to one skilled in the art, the solenoid 231 may be embodied as a pneumatic, or hydraulic mechanism. As depicted, the actuator 231 is a solenoid coupled to wire 235, which is turn is electronically coupled to an engine's computer (not shown). The engine's computer is programmed to selectively actuate the solenoid 231 in response to driving conditions for purposes described hereinafter.

In the embodiment of FIG. 7, connecting rod 214 has first and second ends and a central region disposed therebetween. The first end of connecting rod 214 is coupled to rocker arm 210 via pin 217, which is configured for sliding movement within slot 211 of rocker arm 210. The second end of connecting rod 214 is coupled to valve shaft region 34*b*, preferably using connecting link 74 and pin 75, as described hereinabove. Rod 232, which is coupled to the solenoid 231, in turn is coupled to the central region of connecting rod 214, for example, using pin 236, as depicted in FIGS. 7–8.

Figure 8A:
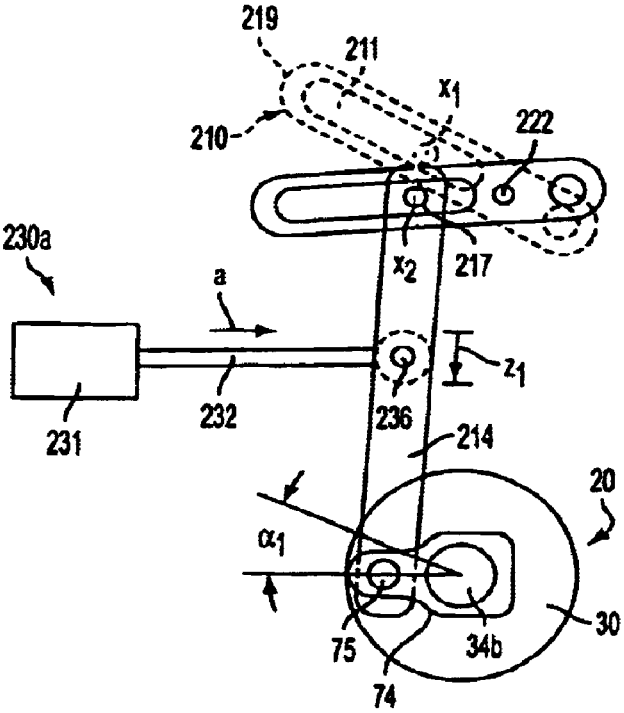
FIGS. 8A–8B are schematics depicting a preferred method of actuation of the means for varying an aperture size of FIG. 7.
Figure 8B:
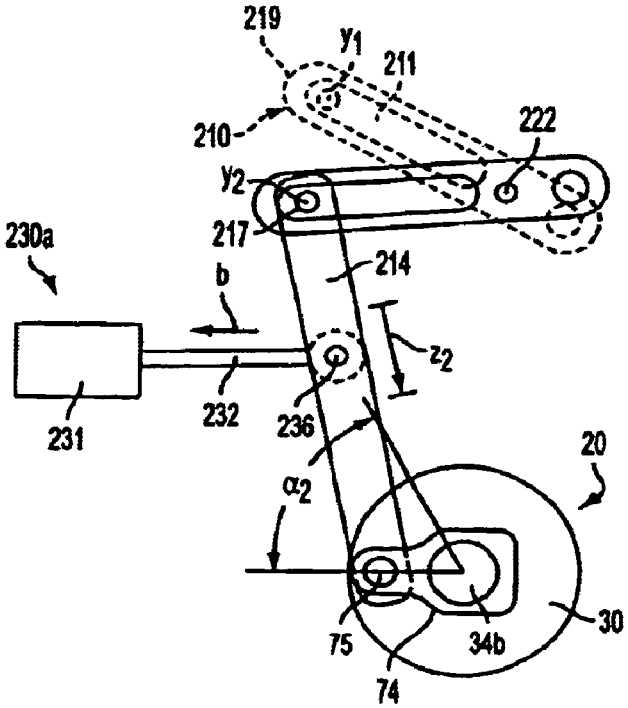

Referring now to FIGS. 8A–8B, features of means for varying an aperture size 230*a* are described in greater detail. In FIG. 8A, the solenoid 231 of means for varying 230*a* is in a relaxed state, whereby no current is supplied to wire 235. When no current is supplied, an internal spring of the solenoid (not shown) causes rod 232 to extend in direction "a", as illustrated by the arrow in FIG. 8A. Movement of rod 232 in direction "a" causes the central region of connecting rod 214 to move in direction "a", and further causes pin 217 to move substantially in direction "a" within slot 211 of rocker arm 210. Pin 217, which is coupled between the first end of connecting rod 214 and rocker arm 210, is disposed at a location $x_1$ within slot 211 when the solenoid 231 is in the relaxed state, as depicted in FIG. 8A.

When rocker arm 210 is actuated by a cam lobe of camshaft 101, as described hereinabove, rocker arm 210 moves between a first position (dashed line in FIG. 8A) and a second position (solid line in FIG. 8A). Therefore, when the solenoid 231 is in the relaxed state, and when camshaft 101 causes actuation of rocker arm 210, pin 217 travels between first position $x_1$ and second position $x_2$, as shown in FIG. 8A. This causes connecting rod 214 to move a distance $z_1$ towards valve 20, and therefore causes partial rotation of valve body 30 approximately $\propto_1$ degrees via connecting link 74.

A reduced aperture size, associated with intake valve 20, may be achieved when means for varying 230*a* is in the position depicted in FIG. 8A. Specifically, the distance pin 217 travels between first position $x_1$ and second position $x_2$ is reduced when pin 217 is in closer proximity to pivot point 222 of rocker arm 210. The reduced travel of pin 217 between first position $x_1$ and second position $x_2$ causes connecting rod 214 to travel a reduced distance, thereby causing reduced rotation of valve body 30. The reduced rotation of valve body 30 results in a reduced overlap between first side port 31 and intake passage 95 of FIG. 3A, resulting in a reduced aperture size associated with intake valve 20.

Referring now to FIG. 8B, when an electric current is provided to the solenoid 231 via wire 235, the solenoid 231 is actuated to cause rod 232 to move in direction "b", as illustrated by the arrow in FIG. 8B. Movement of rod 232 in direction "b" causes the central region of connecting rod 214 to move in direction "b", and further causes pin 217 to move substantially in direction "b" within slot 211 of rocker arm 210. Pin 217, therefore, is disposed at a location $y_1$ within slot 211 when the solenoid 221 is actuated, as shown in FIG. 8B.

When the solenoid 231 is actuated, and when rocker arm 210 moves between the first position (dashed line in FIG. 8B) and the second position (solid line in FIG. 8B), pin 217 travels between first position $y_1$ and second position $y_2$. Accordingly, connecting rod 214 is moved a distance $z_2$ towards valve 20, and therefore causes partial rotation of valve body 30 approximately $\propto_2$ degrees via connecting link 74.

An increased aperture size, associated with valve 20, may be achieved when means for varying 230*a* is in the position depicted in FIG. 8B. Specifically, the distance pin 217 travels between first position $y_1$ and second position $y_2$ is increased when pin 217 is disposed at a distance further from pivot point 222 of rocker arm 210. The increased travel of pin 217 between first position $y_1$ and second position $y_2$ causes connecting rod 214 to travel an increased distance, thereby causing increased rotation of valve body 30. The increased rotation of valve body 30 results in an increased overlap between first side port 31 and intake passage 95 of FIG. 3A during the intake stroke, resulting in an increased aperture size associated with intake valve 20.

Similarly, reduced and increased aperture sizes, associated with exhaust valve 120, may be achieved using means for varying 230*b*, thereby allowing the aperture size of the exhaust valve to vary based on an engine's operating conditions.

It should be noted that relatively small variations in distances $z_1$ and $z_2$ may result in relatively significant changes in degrees of rotation $\propto_1$ and $\propto_2$, as depicted in FIGS. 8A and 8B, respectively. Additionally, relatively small changes in angular positioning of connecting rod 214 with respect to a longitudinal axis (i.e., the longitudinal axis being parallel to direction "a") may result in relatively significant changes in rotation of valve body 30. For example, when connecting rod 214 is substantially orthogonal to the longitudinal axis, as shown in FIG. 8A, rotation of valve body 30 is reduced. When the angle of connecting rod 214 is varied, as depicted in FIG. 8B, relatively significant changes in rotation of valve shaft 30 may be achieved.

Advantageously, in accordance with one object of the present invention, varying aperture sizes associated with intake valve 20 and exhaust valve 120 may compensate for differences in engine speed to improve engine efficiency and reduce fuel consumption and emissions. For example, during acceleration periods, increased aperture sizes may be achieved when means for varying 230*a* is in the position depicted in FIG. 8B. During cruising or idling conditions, reduced aperture sizes may be achieved when means for varying 230*a* is provided in the position shown in FIG. 8A, thereby reducing fuel consumption and emissions.

In accordance with another object of the present invention, selectively varying an aperture size associated with exhaust valve 120, using means for varying 230*b*, is expected to improve engine efficiency. Specifically, selectively providing an increased exhaust aperture size, based on engine conditions, may improve exhaust scavenging, thereby removing more unburned hydrocarbon molecules from the combustion chamber and allowing higher compression ratios.

Figure 9:
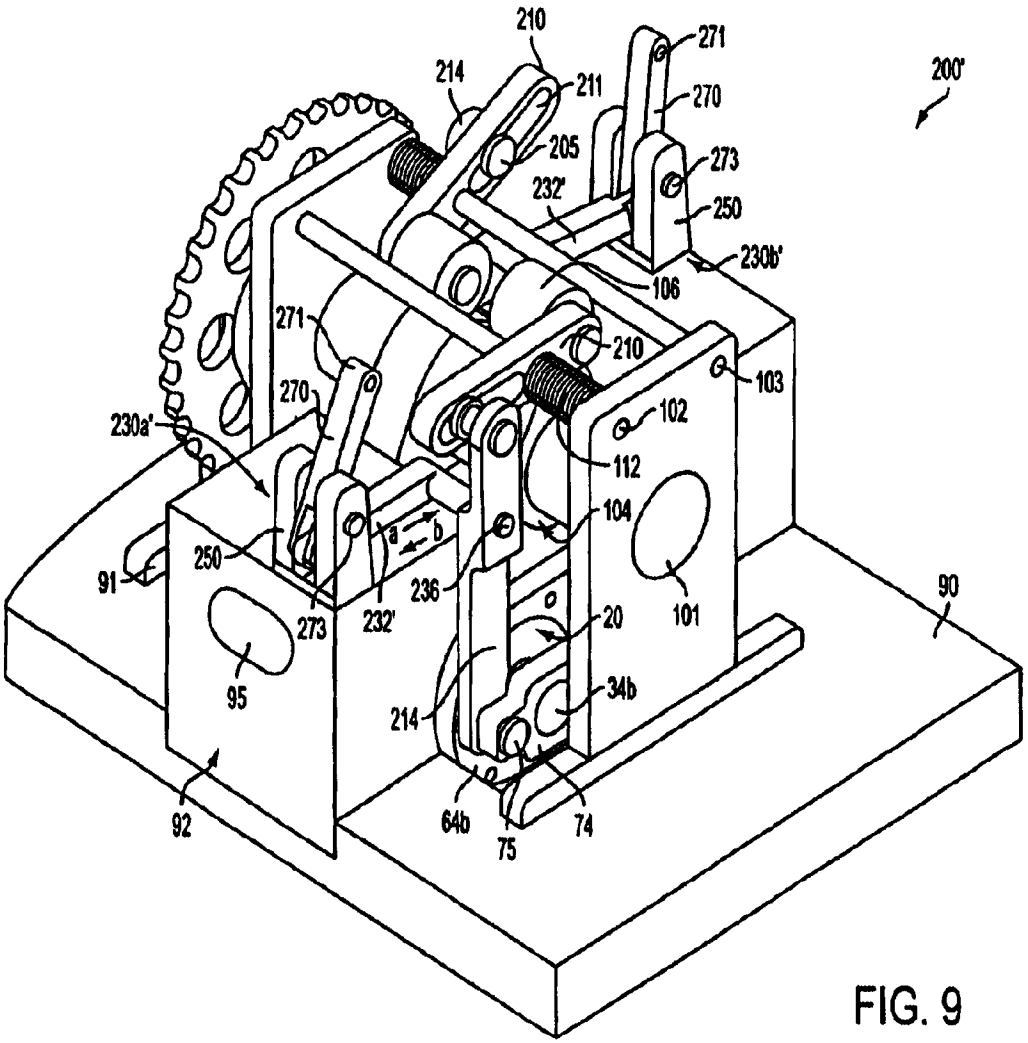
FIG. 9 is a perspective view of an alternative embodiment of the means for varying an aperture size of FIG. 7.

Referring now to FIG. 9, an alternative embodiment of means for varying 230*a* and 230*b* of FIG. 7 is described. In FIG. 9, means for varying an aperture size 230*a*' may be used to vary an intake aperture size, while means for varying 230*b*' may be used to vary an exhaust aperture size. In a preferred embodiment, means for varying 230*a*' and means for varying 230*b*' are substantially identical, and therefore, only means for varying an intake aperture size 230*a*' will be described in detail.

In the embodiment of FIG. 9, means for varying 230*a*' preferably comprises pivoting member 270 having first and second ends and pivot point 273 disposed therebetween. Pivoting member 270 preferably is coupled to support member 250 at pivot point 273, e.g., using a pin, as shown in FIG. 9. The second end of pivoting member 270 is coupled to rod 232, for example, using a pivot pin (not shown).

The first end of pivoting member 270 comprises coupling point 271, as shown in FIG. 9. As will be apparent to one skilled in the art, any number of cables, connecting rods, chains, or other mechanical or electrical connecting elements may be operatively coupled to coupling point 271. In a preferred embodiment, at least one cable (not shown) is operatively coupled between a car's gas pedal and coupling point 271.

When a cable is employed, the cable may be configured to cause coupling point 271 to move in direction "a", for example, during periods of acceleration. Movement of coupling point 271 in direction "a" causes rod 232' to be moved in direction "b", i.e., because pivoting member 270 pivots about pivot point 273.

As described in detail hereinabove with respect to FIG. 8B, movement of rod 232' in direction "b" will cause the central region of connecting rod 214 to move in direction "b", and further causes pin 217 to move substantially in direction "b" within slot 211 of rocker arm 210. Pin 217 then is positioned at a location $y_1$ within slot 211, as shown in FIG. 8B. Actuation of rocker arm 210 causes pin 217 to travel between first position $y_1$ and second position $y_2$, as shown in FIG. 8B and as described in detail hereinabove. Accordingly, connecting rod 214 is moved a distance $z_2$ towards intake valve 20, thereby causing partial rotation of intake valve body 30 via connecting link 74, as described generally in FIG. 8B. Using such techniques, an increased aperture size associated with valve 20 may be achieved when means for varying an aperture size 230*a*' moves coupling point 271 in direction "a", e.g., during acceleration of a vehicle.

During cruising and/or idling operating conditions, the cable or other means coupled between the car's gas pedal and coupling point 271 may cause coupling point 271 to move in direction "b". Movement of coupling point 271 in direction "b" causes rod 232' to be moved in direction "a", since pivoting member 270 pivots about pivot point 273.

As described in detail hereinabove with respect to FIG. 8A, movement of rod 232' in direction "b" causes the central region of connecting rod 214 to move in direction "a", and further causes pin 217 to move substantially in direction "a" within slot 211 of rocker arm 210. Pin 217 then is positioned at a location $x_1$ within slot 211, and travels a reduced distance when rocker arm 210 is actuated by camshaft 101, as described in FIG. 8A hereinabove. Because connecting rod 214 also travels a reduced distance, rotation of valve body 30 is reduced, and a reduced aperture size may be achieved.

Referring still to FIG. 9, when a cable is operatively coupled between a gas pedal and coupling point 271, the cable may incrementally move coupling point 271 in direction "a" or "b", based on whether an increased aperture size or a reduced aperture size is desired, respectively. For example, when a person applies a relatively small force to the gas pedal, the cable may cause coupling point 271 to move a relatively small amount in direction "a", thereby providing a relatively small aperture size. However, if a person applies a significant force to the gas pedal, then the cable may cause coupling point 271 to move a greater distance in direction "a", thereby providing a relatively large aperture size. In this manner, aperture sizes associated with intake valve 20 and exhaust valve 120 may be varied incrementally based on an operating conditions.

As will be apparent to one skilled in the art, various other mechanisms may be employed to actuate pivoting member 270 of FIG. 9. For example, various cable/pulley arrangements may be used, or alternatively, chains, belts, levers, rocker arms, or other mechanical or electrical connectors may be employed to vary an aperture size in accordance with FIG. 9. The mechanical and/or electrical connectors may be coupled directly to a gas pedal, or alternatively, may be coupled to an engine's computer, thereby actuating means for varying 230*a*' and 230*b*' in response to instructions provided by the computer.

Figure 10:
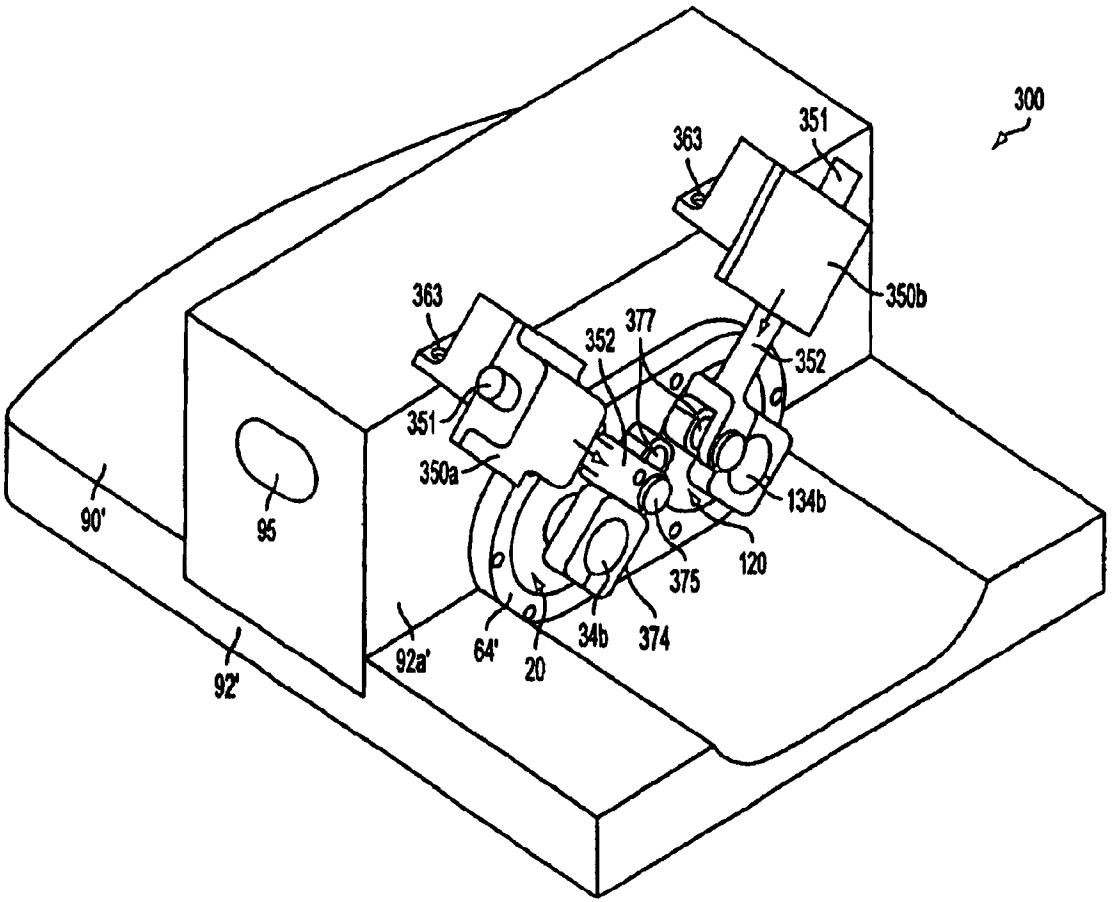
FIG. 10 is a perspective view of an alternative means for actuating that may be used in conjunction with a semi-rotating valve assembly of the present invention.

Referring now to FIG. 10, an alternative embodiment of a means for actuating, which may be used in conjunction with semi-rotating valve 20 of the present invention, is described. In FIG. 10, intake valve 20 and exhaust valve 120 are provided in accordance with semi-rotating valve 20 of FIG. 1, and operate substantially in accordance with methods described hereinabove with respect to FIGS. 3A–3C.

Means for actuating 300 comprises first and second solenoids 350*a* and 350*b* coupled to intake valve 20 and exhaust valve 120, respectively. Each solenoid is operatively coupled to a respective connecting rod 352. A first connecting rod 352 is coupled to valve shaft region 34*b* of intake valve 20, while a second connecting rod 352 is coupled to valve shaft region 134*b* of exhaust valve 120.

The first connecting rod 352 preferably is coupled to valve shaft region 34*b* using connecting link 374 having slot 377. Sliding pin 375 couples connecting link 374 to the first connecting rod 352, as depicted in FIG. 10. Sliding pin 352 is configured to move in a longitudinal direction within slot 377, as needed. In a preferred embodiment, the second connecting rod 352 is coupled to valve shaft region 134*b* in a similar manner.

As will be apparent to one skilled in the art, the solenoids 350*a* and 350*b* may comprise either a hydraulic, pneumatic or electric solenoid. Actuation signals may be sent to coupling points 351, e.g., using a wire when an electric solenoid is employed. When an electric solenoid is used, an interruption in the provision of a current to coupling points 351 will cause connecting rods 352 to move in a downward direction, as illustrated by the arrows in FIG. 10. When a current is provided once again, the connecting rods will be urged in an opposing direction, i.e., the solenoids 350*a* and 350*b*. Accordingly, partial rotation of intake valve 20 and exhaust valve 120, in accordance with principles of the present invention, may be directly effected using means for actuating 300.

In the embodiment of FIG. 10, both valve shaft region 34*b* of intake valve 20 and valve shaft region 134*b* of exhaust valve 120 extend in the same direction away from valve body 92'. Accordingly, actuation of each valve occurs on the same side of valve body 92'. It should be noted that actuation of each valve may occur on the same side of valve body 92', as depicted in FIG. 10, or alternatively, actuation may occur on opposing sides of valve body 92', as generally depicted hereinabove with respect to FIGS. 5–7 and FIG. 9.

Figure 11:
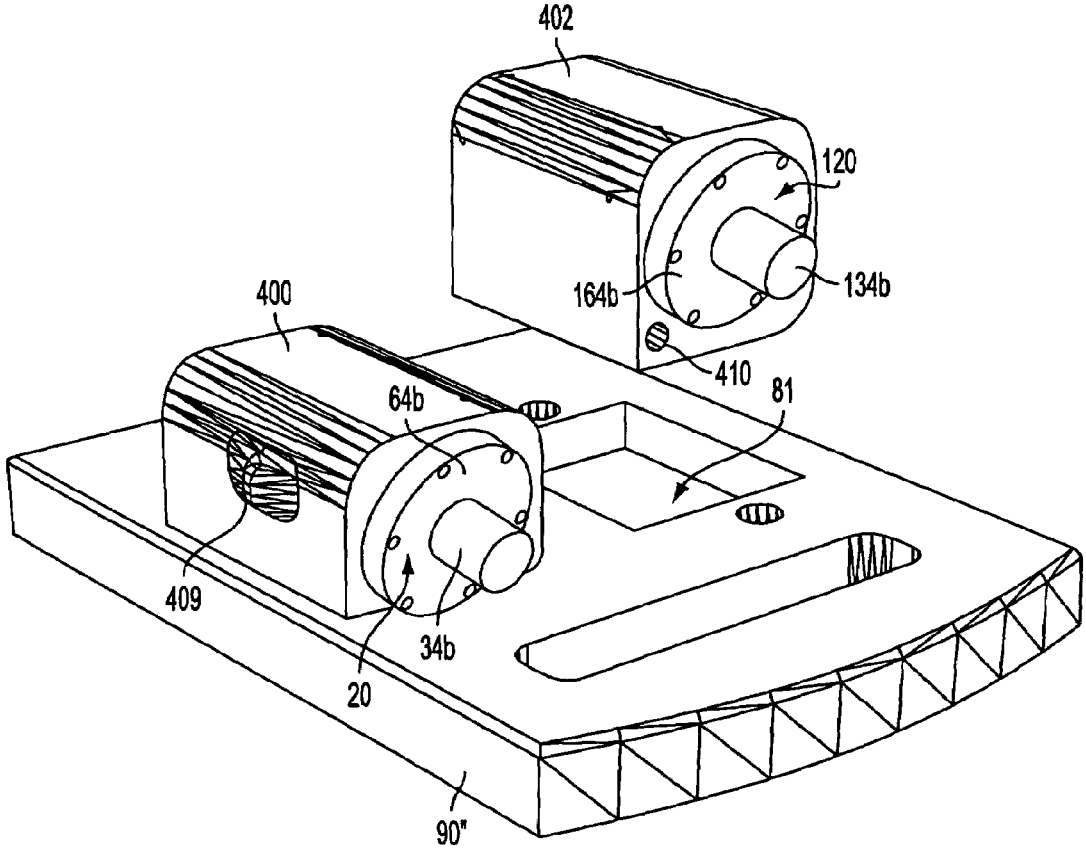
FIG. 11 is a perspective view showing an alternative embodiment of the present invention whereby an intake valve and an exhaust valve are disposed in distinct valve bodies.

Referring now to FIG. 11, an alternative embodiment of the present invention is described whereby two distinct valve bodies are employed. In the embodiment of FIG. 11, intake valve 20 and exhaust valve 120 are both provided in accordance with semi-rotating valve 20 of FIG. 1, and operate substantially in accordance with methods described hereinabove with respect to FIGS. 3A–3C.

In FIG. 11, intake valve body 400 has first side port 409 that is disposed in a lateral surface of the valve body and coupled to an intake passage. Intake valve body 400 further comprises a second side port (not shown) that is disposed on an underside of the valve body and placed in fluid communication with cylinder 81. Similarly, exhaust valve body 402 has first and second side ports (not depicted in FIG. 11) that are in fluid communication with an exhaust passage and cylinder 81, respectively.

As will be apparent to one skilled in the art, any of the means for actuating described hereinabove with respect to FIGS. 5–10 may be employed in the embodiment of FIG. 11 to effect partial rotation of intake valve shaft region 34*b* and exhaust valve shaft region 134*b*. Moreover, in the embodiment of FIG. 11, each distinct valve body 400 and 402 may comprise at least one cooling passage 410 that extends in a longitudinal direction, substantially adjacent the valve shafts, to carry heat away from the valve shafts, for example, as described hereinabove with respect to cooling passages 71 of FIGS. 4A–4B.

While preferred illustrative embodiments of the invention are described above, it will be apparent to one skilled in the art that various changes and modifications may be made therein without departing from the invention. The appended claims are intended to cover all such changes and modifications that fall within the true spirit and scope of the invention.

What is claimed is:

1. Apparatus suitable for regulating flow, and which may be used in conjunction with an internal combustion engine, the apparatus comprising: a valve body having a first side port disposed in a first lateral surface of the valve body, a second side port disposed in a second lateral surface of the valve shaft, and a passage extending between the first side port and the second side port;

means for actuating coupled to the valve body comprising a rocker arm operatively coupled to a camshaft; a first sprocket operatively coupled to the rocker arm; a second sprocket coupled to the valve body; and a linkage coupled between the first sprocket and the second sprocket; and a valve housing having a bore, wherein the valve body is configured to be disposed substantially within the bore, wherein the valve body is configured to rotate less than 360 degrees with respect to the valve housing to regulate flow.

2. The apparatus of claim 1 further including means for actuating configured to rotate the valve body less than 360 degrees in a first direction to achieve an open state.

3. The apparatus of claim 2 wherein the second side port of the valve body is configured to at least partially overlap with an intake port of an internal combustion engine in the open state.

4. The apparatus of claim 2 wherein the second side port of the valve-body is configured to at least partially overlap with an exhaust port of an internal combustion engine in the open state.

5. The apparatus of claim 2 wherein the means for actuating is configured to rotate the valve body less than 360 degrees in an opposing direction to achieve a closed state.

6. The apparatus of claim 5 wherein the second side port of the valve body does not overlap with an intake port of an internal combustion engine in the closed state.

7. The apparatus of claim 5 wherein the second side port of the valve body does not overlap with an exhaust port of an internal combustion engine in the closed state.

8. The apparatus of claim 5 wherein the means configured to rotate comprises at least one spring operatively coupled to the valve body, the spring configured to return the valve shaft to the closed state.

9. The apparatus of claim 1 wherein the means for actuating comprises a camshaft.

10. The apparatus of claim 9 wherein the means for actuating further comprises a rocker arm operatively coupled to the camshaft.

11. The apparatus of claim 1 wherein the rocker arm further comprises a slot, the apparatus further comprising a pin coupling the first sprocket to the rocker arm, wherein the pin is configured for a sliding motion within the slot.

12. The apparatus of claim 1 wherein the means for actuating comprises at least one solenoid.

13. The apparatus of claim 1 wherein the means for actuating is electrically powered.

14. The apparatus of claim 1 wherein the means for actuating is hydraulically powered.

15. The apparatus of claim 1 wherein the means for actuating is pneumatically powered.

16. A method for regulating flow of products for combustion in an internal combustion engine, the method comprising:

rotating an intake aperture in a cylindrical valve body in an intake passage less than 360 degrees to introduce a flow of products for combustion into a combustion chamber of the internal combustion engine;

rotating the intake aperture in a cylindrical valve body in an intake passage less than 360 degrees to achieve a closed state after the introduce products for combustion into a combustion chamber of the internal combustion engine;

rotating an exhaust aperture in a cylindrical valve body in an exhaust passage less than 360 degrees to exhaust a flow of burnt products of combustion from the combustion chamber of the internal combustion engine;

rotating the exhaust aperture in a cylindrical valve body in an exhaust passage less than 360 degrees to achieve a closed state after exhausting burnt products of combustion from the combustion chamber of the internal combustion engine; and varying the degrees of rotation of at least one cylindrical valve body to regulate flow with the combustion chamber.

17. The method of claim 16 including the further step of using a camshaft for each of said steps of rotating.

18. The method of claim 17 further comprising:

providing a rocker arm having a first end operatively coupled to the camshaft and a second end operatively coupled to the valve body; and actuating the rocker arm by said camshaft to effect rotation of the valve body.

19. The method of claim 18 further comprising:

providing a first sprocket operatively coupled to the rocker arm;

providing a second sprocket operatively coupled to the valve shaft, whereby the first sprocket is coupled to the second sprocket using a linkage; and actuating the first sprocket and the second sprocket to effect rotation of the valve shaft.

20. The method of claim 16 further comprising providing means for actuating operatively coupled to the valve body, the means for actuating configured to cause the valve shaft to rotate less than 360 degrees with respect to the valve housing.

21. The method of claim 20 wherein the method further includes effecting rotation of the valve body by selectively actuating a solenoid.

22. The method of claim 20 wherein the method further comprising effecting rotation of the valve body in an opposing direction, using a spring, to achieve a closed state.

23. The method of claim 20 further comprising:

providing means for varying an aperture size, the means for varying operatively coupled to the valve body; and actuating the means for varying to vary a degree of rotation of the valve body.

24. The method of claim 23 wherein the means for varying comprises a solenoid, the method further comprising selectively actuating the solenoid to vary a degree of rotation of the valve shaft.

25. The method of claim 23 wherein the means for varying comprises a plurality of mechanical connecting elements, the method further comprising selectively actuating the plurality of mechanical connecting elements to vary a degree of rotation of the valve body.

26. The method of claim 23 further comprising:

providing a connecting rod coupled to the means for varying, the connecting rod having a first end coupled to the means for actuating and a second end coupled to the valve body; and actuating the connecting rod to vary a degree of rotation of the valve body.

27. The method of claim 16 further comprising providing an interlocking sealing mechanism disposed substantially between the valve body and the valve housing.

28. The method of claim 16 further comprising providing at least one cooling passage disposed substantially adjacent the bore of the valve housing.

29. Apparatus suitable for regulating intake into a cylinder of an internal combustion engine, and further regulating exhaust from the cylinder, the apparatus comprising:

an intake valve body having a first side port disposed in a first lateral surface of the intake valve body, a second side port disposed in a second lateral surface of the intake valve body, and a passage extending between the first side port and the second side port;

an exhaust valve body having a first side port disposed in a first lateral surface of the exhaust valve body, a second side port disposed in a second lateral surface of the exhaust valve body, and a passage extending between the first side port and the second side port;

an intake valve housing having a bore, wherein the intake valve body is configured to be disposed substantially within the bore of the intake valve housing;

means for actuating the intake valve body and the exhaust valve body;

an exhaust valve housing having a bore, wherein the exhaust valve body is configured to be disposed substantially within the bore of the exhaust valve housing, wherein the intake valve body is configured to rotate less than 360 degrees with respect to the intake valve housing, and the exhaust valve is configured to rotate less than 360 degrees with respect to the exhaust valve housing; and means for varying an aperture size coupled to the intake valve body.

30. The apparatus of claim 29 wherein the means for varying comprises a solenoid.

31. Apparatus suitable for regulating intake into a cylinder of an internal combustion engine, and further regulating exhaust from the cylinder, the apparatus comprising:

an intake valve body having a first side port disposed in a first lateral surface of the intake valve body, a second side port disposed in a second lateral surface of the intake valve body, and a passage extending between the first side port and the second side port;

an exhaust valve body having a first side port disposed in a first lateral surface of the exhaust valve body, a second side port disposed in a second lateral surface of the exhaust valve body, and a passage extending between the first side port and the second side port;

an intake valve housing having a bore, wherein the intake valve body is configured to be disposed substantially within the bore of the intake valve housing;

means for actuating the intake valve body and the exhaust valve body an exhaust valve housing having a bore, wherein the exhaust valve body is configured to be disposed substantially within the bore of the exhaust valve housing, wherein the intake valve body is configured to rotate less than 360 degrees with respect to the intake valve housing, and the exhaust valve is configured to rotate less than 360 degrees with respect to the exhaust valve housing; and means for varying an aperture size coupled to the exhaust valve body.

32. The apparatus of claim 31 wherein the means for varying comprises a solenoid.

33. Apparatus suitable for varying an aperture size associated with a valve, the apparatus comprising:

a valve body having a first side port disposed in a first lateral surface of the valve body, a second side port disposed in a second lateral surface of the valve body, and a passage extending between the first side port and the second side port;

a valve housing having a bore, wherein the valve body is configured to be disposed substantially within the bore; and means configured to vary a degree of rotation of the valve body for varying an aperture size associated with the valve body based on overlap of the first side port and an intake passage of an internal combustion engine.

34. The apparatus of claim 33 wherein the means for varying comprises a solenoid.

35. The apparatus of claim 33 wherein the means for varying comprises a pneumatically powered actuator.

36. The apparatus of claim 33 wherein the means for varying comprises a hydraulically powered actuator.

37. Apparatus suitable for varying an aperture size associated with a valve, the apparatus comprising:

a valve body having a first side port disposed in a first lateral surface of the valve body, a second side port disposed in a second lateral surface of the valve body, and a passage extending between the first side port and the second side port;

a valve housing having a bore, wherein the valve body is configured to be disposed substantially within the bore; and means configured to vary a degree of rotation of the valve body for varying an aperture size associated with the valve shaft based on overlap of the first side port and an exhaust passage of an internal combustion engine.

38. The apparatus of claim 37 wherein the means for varying comprises a solenoid.

39. The apparatus of claim 37 wherein the means for varying comprises a pneumatically powered actuator.

40. The apparatus of claim 37 wherein the means for varying comprises a hydraulically powered actuator.

41. Apparatus suitable for varying an aperture size associated with a valve, the apparatus comprising:

a valve body having a first side port disposed in a first lateral surface of the valve body, a second side port disposed in a second lateral surface of the valve body, and a passage extending between the first side port and the second side port;

a valve housing having a bore, wherein the valve body is configured to be disposed substantially within the bore; and means configured to vary a degree of rotation of the valve body for varying an aperture size associated with the valve body based on overlap of the first second port and an intake port of an internal combustion engine.

42. The apparatus of claim 41 wherein the means for varying comprises a solenoid.

43. The apparatus of claim 41 wherein the means for varying comprises a pneumatically powered actuator.

44. The apparatus of claim 41 wherein the means for varying comprises a hydraulically powered actuator.

45. Apparatus suitable for varying an aperture size associated with a valve, the apparatus comprising:

a valve body having a first side port disposed in a first lateral surface of the valve body, a second side port disposed in a second lateral surface of the valve body, and a passage extending between the first side port and the second side port;

a valve housing having a bore, wherein the valve body is configured to be disposed substantially within the bore; and means configured to vary a degree of rotation of the valve body for varying an aperture size associated with the valve body based on overlap of the second side port and an exhaust port of an internal combustion engine.

46. The apparatus of claim 45 wherein the means for varying comprises a solenoid.

47. The apparatus of claim 45 wherein the means for varying comprises a pneumatically powered actuator.

48. The apparatus of claim 45 wherein the means for varying comprises a hydraulically powered actuator.

49. Apparatus suitable for varying an aperture size associated with a valve, the apparatus comprising:

a valve body having a first side port disposed in a first lateral surface of the valve body, a second side port disposed in a second lateral surface of the valve body, and a passage extending between the first side port and the second side port;

a valve housing having a bore, wherein the valve body is configured to be disposed substantially within the bore;

means for actuating the valve body, the means for actuating configured to cause the valve body to rotate less than 360 degrees with respect to the valve housing, and the means for actuating comprises: a camshaft having at least one cam;

a rocker arm having a slot, wherein the camshaft is operatively coupled to the rocker arm; and a pin disposed for sliding movement within the slot, the pin coupled between the rocker arm and the connecting rod; and means to vary the degree of rotation of the valve body for varying an aperture size associated with the valve body, the means for varying being coupled to a connecting rod having a first end coupled to the means for actuating and a second end coupled to the valve body, and wherein the means for varying an aperture size is configured to influence a longitudinal distance that the connecting rod travels and thereby effect rotation of the valve body.

50. The apparatus of claim 49 wherein the means for varying is configured to effect a longitudinal positioning of the pin within the slot.

51. The apparatus of claim 50 wherein the longitudinal positioning of the pin within the slot affects the aperture size.

52. The apparatus of claim 51 wherein an increase in aperture size is achieved when the pin is disposed a further distance from a pivot point of the rocker arm.

53. The apparatus of claim 51 wherein a reduction in aperture size is achieved when the pin is disposed a closer distance to a pivot point of the rocker arm.

* * * * *